US007832503B2

(12) United States Patent
Sand et al.

(10) Patent No.: US 7,832,503 B2
(45) Date of Patent: Nov. 16, 2010

(54) DOWNHOLE MOTOR WITH A CONTINUOUS CONDUCTIVE PATH

(75) Inventors: Byron John Sand, Sherwood Park (CA); Edward James Cargill, Westerose (CA); Gueorgui (George) Stovbour, Edmonton (CA); Ryan Federowich, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 860 days.

(21) Appl. No.: 11/508,257

(22) Filed: Aug. 23, 2006

(65) Prior Publication Data

US 2007/0251729 A1 Nov. 1, 2007

(30) Foreign Application Priority Data

May 1, 2006 (CA) ..... 2545377

(51) Int. Cl.
*E21B 4/02* (2006.01)
*H01R 39/12* (2006.01)

(52) U.S. Cl. ..... 175/107; 175/320; 384/476; 439/17

(58) Field of Classification Search ..... 175/104, 175/107, 320; 439/17; 384/476; 361/221
See application file for complete search history.

(56) References Cited

U.S. PATENT DOCUMENTS 3,170,137 A 2/1965 Brandt
3,581,267 A * 5/1971 Schreffler ..... 439/3
3,696,332 A 10/1972 Dickson, Jr. et al.
3,823,787 A 7/1974 Haworth et al.
3,866,678 A 2/1975 Jeter
4,012,092 A 3/1977 Godbey
4,051,456 A 9/1977 Heilhecker et al.

(Continued)

FOREIGN PATENT DOCUMENTS

CA 2298375 9/2000

(Continued)

OTHER PUBLICATIONS

Abyzbayev, B.I. et. al., "Electrodrilling: Past Experience and Present Opportunities," Society of Petroleum Engineers, SPE 38624, pp. 573-588.

(Continued)

*Primary Examiner*—William P Neuder
*Assistant Examiner*—Robert E Fuller
(74) *Attorney, Agent, or Firm*—Terrence N. Kuharchuk; Malcolm E. Whittaker; William E. Shull

(57) ABSTRACT

A downhole drilling motor comprising a housing and a shaft extending within the housing, wherein the shaft is movable relative to the housing. Further, a conducting path extends within the housing between a first axial position and a second axial position. The conducting path comprises a housing conductor associated with the housing and a shaft conductor associated with the shaft, wherein the shaft conductor is capable of a movement relative to the housing conductor. An assimilating connector is interposed between the housing conductor and the shaft conductor for conductively connecting the housing conductor with the shaft conductor and for assimilating the movement of the shaft conductor relative to the housing conductor. The assimilating connector includes one or more of a rotary movement assimilating connector, a longitudinal movement assimilating connector and a transverse movement assimilating connector.

29 Claims, 11 Drawing Sheets

U.S. PATENT DOCUMENTS

| | | | | |
|---|---|---|---|---|
| 4,057,781 | A | | 11/1977 | Scherbatskoy |
| 4,431,964 | A | | 2/1984 | Walkow |
| 4,475,779 | A | * | 10/1984 | Fohl ..... 439/21 |
| 4,496,174 | A | | 1/1985 | McDonald et al. |
| 4,529,939 | A | | 7/1985 | Kuckes |
| 4,605,268 | A | | 8/1986 | Meador |
| 4,691,203 | A | | 9/1987 | Rubin et al. |
| 4,722,402 | A | | 2/1988 | Weldon |
| 4,725,837 | A | | 2/1988 | Rubin |
| 4,899,834 | A | | 2/1990 | Weldon |
| 5,018,590 | A | | 5/1991 | Weldon |
| 5,034,929 | A | | 7/1991 | Cobern et al. |
| 5,060,737 | A | | 10/1991 | Mohn |
| 5,139,094 | A | | 8/1992 | Prevedel et al. |
| 5,160,925 | A | | 11/1992 | Dailey et al. |
| 5,163,521 | A | | 11/1992 | Pustanyk et al. |
| 5,171,139 | A | | 12/1992 | Underwood et al. |
| 5,314,030 | A | | 5/1994 | Peterson et al. |
| 5,359,324 | A | | 10/1994 | Clark et al. |
| 5,410,303 | A | | 4/1995 | Comeau et al. |
| 5,602,541 | A | | 2/1997 | Comeau et al. |
| 5,725,061 | A | | 3/1998 | Van Steenwyk et al. |
| 5,866,967 | A | | 2/1999 | Sasaki |
| 6,158,529 | A | | 12/2000 | Dorel |
| 6,244,361 | B1 | | 6/2001 | Comeau et al. |
| 6,269,892 | B1 | | 8/2001 | Boulton et al. |
| 6,392,561 | B1 | | 5/2002 | Davies et al. |
| 6,446,736 | B1 | | 9/2002 | Kruspe et al. |
| 6,464,011 | B2 | | 10/2002 | Tubel |
| 6,540,032 | B1 | | 4/2003 | Krueger |
| 2002/0113716 | A1 | | 8/2002 | Aiello |
| 2004/0119607 | A1 | | 6/2004 | Davies et al. |
| 2006/0124354 | A1 | * | 6/2006 | Witte ..... 175/40 |
| 2007/0079988 | A1 | | 4/2007 | Konschuh et al. |

FOREIGN PATENT DOCUMENTS

| | | |
|---|---|---|
| EP | 0 718 641 A2 | 6/1996 |
| EP | 0 540 425 B1 | 9/1996 |
| GB | 2177738 | 1/1987 |
| GB | 2307537 | 5/1997 |
| WO | WO 92/18882 | 10/1992 |
| WO | WO 00/61916 | 10/2000 |

OTHER PUBLICATIONS

Sperry-Sun Drilling Services, Inc., catalogue entitled "Sourcebook," 1996, pp. 33-44 ("Measurement-While-Drilling-Systems").

Sperry-Sun Drilling Services, Inc., "Sperry Drill Technical Information Handbook," undated, pp. 2-17.

* cited by examiner

DOWNHOLE MOTOR WITH A CONTINUOUS CONDUCTIVE PATH

TECHNICAL FIELD

A downhole drilling motor which includes a continuous conductive path for transmission of power and/or communication signals through the drilling motor.

BACKGROUND OF THE INVENTION

Directional drilling involves controlling the direction of a borehole as it is being drilled. Since boreholes are drilled in three dimensional space, the direction of a borehole includes both its inclination relative to vertical as well as its azimuth. Usually the goal of directional drilling is to reach a target subterranean destination with the drilling string, typically a potential hydrocarbon producing formation.

Directional drilling typically requires the use of a bottom hole assembly (BHA) at or near the end of the drilling string which incorporates drilling tools for controlling the drilling direction. Such tools may typically include one or more drilling motors and/or one or more rotary steerable tools.

In order to optimize the drilling operation and wellbore placement, it is often desirable to be provided with information concerning the environmental conditions of the surrounding formation being drilled and information concerning the operational and directional parameters of the drilling string, including the bottom hole assembly. For example, it is often necessary to adjust the direction of the borehole frequently while directional drilling, either to accommodate a planned change in direction or to compensate for unintended and unwanted deflection of the borehole.

In addition, it is often desirable that the information concerning the environmental, directional and operational parameters of the drilling operation be provided to the operator on a reasonably current (i.e., "real time") basis. The ability to obtain real time information while drilling potentially facilitates a relatively more economical and more efficient drilling operation.

For example, the performance of a bottom hole assembly, and in particular the performance and life of a downhole motor, may be optimized by the real time transmission of the temperature of the bearings of the motor or the rotations per minute of the drive shaft of the motor. Similarly, the drilling operation itself may be optimized by the real time transmission of information relating to environmental or borehole conditions, such as measurements of natural gamma rays, borehole inclination, borehole pressure, resistivity of the formation and weight on bit. Real time transmission of this information permits real time adjustments in the operating parameters of the bottom hole assembly and real time adjustments to the drilling operation itself.

Accordingly, borehole telemetry systems have been developed which enable the gathering of relevant information downhole and the transmission of the information to the surface on a real time basis.

For example, mud pulse telemetry systems transmit signals to the surface through the drilling mud in the drilling string, which signals may include information gathered from one or more downhole sensors. More particularly, pressure signals, modulated with information from the downhole sensors, can be transmitted from downhole and can be received and demodulated at the surface. The downhole sensors may include various sensors such as gamma ray, resistivity, porosity or temperature sensors for measuring formation characteristics or other downhole parameters. In addition, the downhole sensors may include one or more magnetometers, accelerometers or other sensors for measuring the direction or inclination of the borehole, weight-on-bit or other drilling parameters.

Mud pulse telemetry systems are typically located above the bottom hole assembly. For example, when used with a downhole motor, a mud pulse telemetry system is typically located above the motor so that it is spaced a substantial distance from the drill bit. One reason for this is that it may be difficult if not impossible to pass mud pulses through the downhole motor or through the other components of the downhole motor drilling assembly without incurring significant interference or noise.

In addition, the downhole sensors associated with the mud pulse telemetry system are often similarly located above the bottom hole assembly, again due to the difficulty in transmitting the information from the sensors through the bottom hole assembly.

As a result, environmental information obtained from the downhole sensors may not necessary correlate with the actual conditions at or adjacent to the drill bit. Rather, the sensors are providing information relating to conditions which are substantially spaced from the drill bit. For example, a conventional mud pulse telemetry system and associated downhole sensors may have a depth lag relative to the drill bit of up to or greater than 60 feet (18.28 meters).

Because of this depth lag, it is possible to drill out of a hydrocarbon producing formation before detecting the exit, resulting in the need to drill several meters of borehole to get back into the pay zone. The interval drilled outside of the pay zone results in costly lost production over that interval over the life of the well. In some cases this may represent millions of dollars in lost production revenue to the operator, not to mention the wasted cost of putting completion equipment over the non-producing interval to reach producing zones further down in the well.

Other difficulties arise with the depth lag between the downhole sensors and the drill bit in deciding when it is appropriate to stop drilling and run casing in the borehole, which decision is often driven by formation characteristics. For example, it is often desirable to set a casing section in or before certain formations to avoid further drilling or production problems after completion of the borehole.

To overcome this undesirable depth lag, "near bit" sensors have been developed which are designed to be placed adjacent to or near the drill bit. Near bit sensors provide early detection of changes to the formation while drilling, minimizing the need for lengthy corrective drilling intervals and service costs. The drilling operation, including the trajectory of the drill bit, may then be adjusted in response to the sensed information, which information is more closely indicative of the actual conditions existing at the drill bit than if the sensors are located above the bottom hole assembly.

In order to use near bit sensors, a system or method must typically be provided for transmitting information from the downhole sensors either to a telemetry system located above the bottom hole assembly or directly to the surface. A system or method may also be required for conveying the required electrical power to the downhole sensors from the surface or from some other power source located downhole. Various attempts have been made to provide a system or method for transmitting information and/or power directly or indirectly between a location at or below a bottom hole assembly and a location above the bottom hole assembly.

As one example, acoustic and seismic telemetry systems have been developed for the transmission of acoustic or seismic signals or waves through the drilling string or surrounding formation. The acoustic or seismic signals are generated by a downhole acoustic or seismic generator. However, a relatively large amount of power is typically required in order to generate a signal of sufficient magnitude that the signal is detectable at the surface. As a result, a large amount of electrical power must be supplied downhole or repeater transceivers must be used at intervals along the drilling string to boost the signal as it propagates along the drilling string toward the surface.

U.S. Pat. No. 5,163,521 issued Nov. 17, 1992 to Pustanyk et. al., U.S. Pat. No. 5,410,303 issued Apr. 25, 1995 to Comeau et. al., and U.S. Pat. No. 5,602,541 issued Feb. 11, 1997 to Comeau et. al. all describe a telemetry tool, a downhole motor having a bearing assembly, and a drill bit. A sensor and a transmitter are provided in a sealed cavity within the housing of the downhole motor adjacent the drill bit. A signal from the sensor is transmitted by the transmitter to a receiver in the telemetry tool, which telemetry tool then transmits the information to the surface. The signals are transmitted from the transmitter to the receiver by a wireless system. Specifically, the information is transmitted by frequency modulated acoustic signals indicative of the sensed information. Preferably, the transmitted signals are acoustic signals having a frequency in the range below 5000 Hz.

As a second example, electromagnetic telemetry systems have been developed which rely upon the transmission of electromagnetic signals through the formation surrounding the drilling string. There are two different types of electromagnetic telemetry systems which are typically used downhole.

In a first type of electromagnetic telemetry system, a toroid is positioned within the drilling string for generation of an electromagnetic wave through the formation. Specifically, a primary winding, carrying the sensed information, is wrapped around the toroid and a secondary winding is formed by the drilling string. A receiver for detecting the electromagnetic waves may be connected to the ground at the surface or may be associated with a telemetry system or a repeater transceiver located at a position uphole from the transmitter. In this first type of electromagnetic telemetry system, the outer sheath of the drilling string must protect the windings of the toroid while continuing to provide structural integrity to the drilling string. This requirement presents design challenges due to the relatively high stresses to which the drilling string is typically exposed during drilling operations.

In a second type of electromagnetic telemetry system, an electrical discontinuity is created in the drilling string. The electrical discontinuity typically comprises an insulative gap or insulated zone in the drilling string. Such an electromagnetic telemetry system is described in U.S. Pat. No. 4,691,203 issued Sep. 1, 1987 to Rubin et al. The insulative gap may be provided by an insulating material comprising a substantial area of the outer sheath or surface of the drilling string. The insulating material may extend for several inches or several feet along the drilling string. The presence of this insulative gap of insulating material may interfere with the structural integrity of the drilling string and may also be susceptible to damage during drilling operations.

As with acoustic and seismic telemetry systems, electromagnetic telemetry systems also typically require a relatively large amount of electrical power, due to attenuation of the electromagnetic signals as they travel toward the surface. Attenuation of the electromagnetic signals as they are propagated through the formation is directly related to the distance over which the signals must be transmitted, the data transmission rate and the electrical resistivity of the formation. The conductivity and the heterogeneity of the surrounding formation may particularly adversely affect the propagation of the electromagnetic radiation through the formation. As a result, electrical power must be supplied downhole or repeater transceivers must be used at intervals along the drilling string to boost the signal as it propagates along the drilling string toward the surface.

Various attempts have been made in the prior art to address the difficulties or disadvantages associated with electromagnetic telemetry systems. However, none of these attempts have provided a fully satisfactory solution as each continues to require the propagation of an electromagnetic signal through the formation. Examples include: U.S. Pat. No. 4,496,174 issued Jan. 29, 1985 to McDonald et. al.; U.S. Pat. No. 4,725,837 issued Feb. 16, 1988 to Rubin; U.S. Pat. No. 4,691,203 issued Sep. 1, 1987 to Rubin et. al.; U.S. Pat. No. 5,160,925 issued Nov. 3, 1992 to Dailey et. al.; PCT International Application PCT/US92/03183 published Oct. 29, 1992 as WO 92/18882; U.S. Pat. No. 5,359,324 issued Oct. 25, 1994 to Clark et. al. and European Patent Specification EP 0 540 425 B1 published Sep. 25, 1996.

U.S. Pat. No. 6,392,561 issued May 21, 2002 to Davies et. al. describes a telemetry system for transmitting electrical signals embodying information from downhole sensors through portions of a downhole motor using components of the motor as a conducting path. This telemetry system relies upon inductive coupling between the transceivers and the conducting path and upon a slip ring mechanism for transmitting the electrical signals between rotating and non-rotating components of the motor within the conducting path.

U.S. Patent Application Publication No. US 2004/0119607 A1 by Davies et al describes a telemetry system and method for communicating information axially along a drilling string using components of the drilling string as a conducting path. This telemetry system relies upon inductive coupling between the transceivers and the conducting path and upon a slip ring mechanism for transmitting the electrical signals between rotating and non-rotating components of a motor contained within the drilling string.

U.S. Pat. No. 5,725,061 issued Mar. 10, 1998 to Van Steenwyk et al describes a downhole drill bit drive motor assembly which provides a bilateral low resistance path from the upper end of the motor to the lower end of the motor by employing an insulated wire or a group of several wires through the rotor of the motor. Fixed electrical contacts are provided at the upper end of the motor to provide a connection to a wireline. Rotary electrical contacts which provide continuous electrical contact as a rotary portion rotates relative to a stationary portion are provided at the upper end, the lower end or at both ends of the rotor. An electrical conductor extends through the interior of the rotor, a coupling and an output shaft to the bit box on the end of the output shaft. The rotary electrical contact is comprised of an electrical swivel assembly providing direct electrical contact between related rotating conducting parts or a rotary transformer apparatus for the transmission of alternating current power and signal data by magnetic coupling means.

There remains a need for a downhole drilling motor which provides a conducting path substantially therethrough which facilitates the transmission of power and/or communication signals through the drilling motor.

There is also a need for a downhole drilling motor which can be incorporated into a telemetry system for transmitting power and/or communication signals between locations above and below the drilling motor.

There is also a need for a downhole drilling motor which includes an assimilating connector for conductively connecting conductors of a conducting path extending through the motor which are capable of a movement relative to each other.

There is also a need for an assimilating connector for conductively connecting a first conductor and a second conductor which are capable of a movement relative to each other.

SUMMARY OF THE INVENTION

The present invention is a downhole drilling motor which includes an assimilating connector for conductively connecting conductors of a conducting path extending through the motor, which conductors are capable of a movement relative to each other.

The present invention is also an assimilating connector for conductively connecting a first conductor and a second conductor which are capable of a movement relative to each other.

The relative movement of the conductors of the conducting path may be comprised of a rotary movement, a longitudinal movement, a transverse movement, or combinations thereof.

The purpose of the conducting path is to facilitate the transmission of power and/or communication signals. The conducting path may be configured to transmit acoustic signals, electromagnetic signals, optical signals, electrical signals, or any other types of power and/or communication signals.

Preferably the signals are electrical signals so that the conducting path is an electrical conducting path and the conductors are electrical conductors.

In a first aspect, the invention is a downhole drilling motor comprising:

(a) a housing;

(b) a shaft extending within the housing, wherein the shaft is movable relative to the housing;

(c) a conducting path extending within the housing between a first axial position and a second axial position, wherein the conducting path comprises:

(i) a housing conductor associated with the housing;

(ii) a shaft conductor associated with the shaft, wherein the shaft conductor is capable of a movement relative to the housing conductor; and (iii) an assimilating connector interposed between the housing conductor and the shaft conductor for conductively connecting the housing conductor with the shaft conductor and for assimilating the movement of the shaft conductor relative to the housing conductor.

The drilling motor is comprised of a power unit which generates the power provided by the drilling motor. The power unit may be comprised of a progressing cavity assembly comprising a rotor and a stator. Alternatively the power unit may be comprised of a rotary turbine assembly, a reciprocating hammer assembly or any other type of power unit which is suitable for use in a drilling motor. Preferably the power unit is comprised of a progressing cavity assembly.

The drilling motor may be further comprised of components in addition to the power unit. For example, the drilling motor may be comprised of a transmission unit, a bearing assembly, a bottom sub and/or a dump sub. The components of the drilling motor may be permanently or temporarily connected together to form the drilling motor.

The housing of the drilling motor may be comprised of a single tubular section or may be comprised of a plurality of tubular sections which are connected together by a threaded connection, a welded connection, or in some other manner. For example, each of the components of the drilling motor may be comprised of one or more sections of the housing. Preferably the power unit of the drilling motor is comprised of one or more sections of the housing which define a stator of a progressing cavity assembly.

The shaft of the drilling motor may be comprised of a single member or may be comprised of a plurality of members which are connected together by a threaded connection, a welded connection, or in some other manner. The shaft of the drilling motor may extend substantially through the entire housing or through only a portion of the housing, depending upon the configuration of the drilling motor and the components which are included in the drilling motor.

Preferably the power unit of the drilling motor is comprised of one or more members of the shaft which define a rotor of a progressing cavity assembly. As a result, the shaft of the drilling motor may be comprised of a drive shaft which extends within the bottom sub of the drilling motor and the bearing sub of the drilling motor, a transmission shaft assembly or a flex shaft which extends through the transmission unit of the drilling motor, and a rotor which extends through the power unit of the drilling motor.

The conducting path may be configured to transmit acoustic signals, electromagnetic signals, optical signals, electrical signals, or any other types of power and/or communication signals. Preferably the conducting path is an electrical conducting path so that the conducting path transmits electrical power and/or communication signals between the first axial position and the second axial position.

The first axial position and the second axial position may be located at any positions within the housing. Preferably the first axial position and the second axial position are each located adjacent to a connection between two sections of the housing so that drilling motor components or other components of the drilling string can easily interface and connect with the conducting path.

The housing conductor and the shaft conductor may be comprised of any device, structure or apparatus which is capable of conducting power and/or communication signals. For example, the housing conductor and the shaft conductor may be comprised of an acoustic conductor, an electromagnetic conductor, an optical conductor or an electrical conductor. Preferably the housing conductor and the shaft conductor are comprised of a housing electrical conductor and a shaft electrical conductor respectively so that the conducting path is an electrical conducting path and so that the assimilating connector electrically connects the housing electrical connector and the shaft electrical connector.

The housing electrical conductor may be comprised of or may consist of conductive parts of the housing, electrical wire, electrical cable, fittings or combinations thereof, such that the housing electrical conductor is associated with the housing. Preferably the housing electrical conductor is attached to or connected with the housing such that the housing electrical conductor moves with the housing.

The shaft electrical conductor may be comprised of or may consist of conductive parts of the shaft, electrical wire, electrical cable, fittings or combinations thereof, such that the shaft electrical conductor is associated with the shaft. Preferably the shaft electrical conductor is attached to or connected with the shaft such that the shaft electrical conductor moves with the shaft.

The drilling motor may be comprised of a single conducting path. The drilling motor may alternatively be comprised of more than one conducting path, thus providing "channels" which facilitate the transmission of power and/or communication signals separately or over more than one channel. Each conducting path may be comprised of a separate assimilating connector or an assimilating connector may be shared amongst a plurality of conducting paths. Preferably a single assimilating connector is shared amongst all of the conducting paths.

The assimilating connector may be comprised of a rotary movement assimilating connector for assimilating a rotary movement of the shaft conductor relative to the housing conductor. The rotary movement assimilating connector may be comprised of any structure, device or apparatus which is capable of conductively connecting the housing conductor with the shaft conductor while assimilating the relative rotary movement.

The assimilating connector may be comprised of a longitudinal movement assimilating connector for assimilating a longitudinal movement of the shaft conductor relative to the housing conductor. The longitudinal movement assimilating connector may be comprised of any structure, device or apparatus which is capable of conductively connecting the housing conductor with the shaft conductor while assimilating the relative longitudinal movement.

The assimilating connector may be comprised of a transverse movement assimilating connector for assimilating a transverse movement of the shaft conductor relative to the housing conductor. The transverse movement assimilating connector may be comprised of any structure, device or apparatus which is capable of conductively connecting the housing conductor with the shaft conductor while assimilating the relative transverse movement.

The assimilating connector may be comprised of one or more of the rotary movement assimilating connector, the longitudinal movement assimilating connector and the transverse movement assimilating connector.

The rotary movement assimilating connector may be comprised of a bearing assembly for conductively connecting the housing conductor with the shaft conductor. Where the conducting path is comprised of an electrical conducting path, the bearing assembly is preferably comprised of a bearing electrical path through the bearing assembly for electrically connecting the housing electrical conductor with the shaft electrical conductor.

The bearing assembly may be comprised of any suitable type of a radial bearing, a thrust bearing, or combinations thereof. As a first example the bearing assembly may be comprised of at least one roller bearing and the bearing electrical path may be comprised of the roller bearing. As a second example the bearing assembly may be comprised of at least one tapered roller bearing and the bearing electrical path may be comprised of the tapered roller bearing. As a third example the bearing assembly may be comprised of at least one hollow tapered roller bearing and the bearing electrical path may be comprised of the hollow tapered roller bearing.

The bearing assembly may be comprised of a preloading mechanism for preloading the bearing assembly. Preloading the bearing assembly may enhance the electrical connection between the housing electrical conductor and the shaft electrical conductor by minimizing disruption of the bearing electrical path due to relative movement of the housing electrical conductor and the shaft electrical conductor. The preloading mechanism may be comprised of any suitable mechanism for urging the bearing surfaces of the bearing assembly into engagement with each other. Preferably the preloading mechanism is comprised of one or more springs such as annular disk springs or coil springs.

The bearing assembly may define a bearing chamber and an electrically conductive fluid may be contained in the bearing chamber. The electrically conductive fluid may enhance the bearing electrical path. The electrically conductive fluid may be comprised of any suitable conductive fluid. Preferably the electrically conductive fluid is or is comprised of a lubricant for lubricating the bearing assembly.

The bearing assembly may be constructed essentially of non-magnetic materials so that electrical interference and/or noise in the bearing electrical path due to induced electrical currents may be minimized.

The longitudinal movement assimilating connector may be comprised of a reciprocable contact assembly for conductively connecting the housing conductor with the shaft conductor. Where the conducting path is comprised of an electrical conducting path, the reciprocable contact assembly is preferably comprised of a reciprocable electrical contact assembly for electrically connecting the housing electrical conductor with the shaft electrical conductor.

The reciprocable electrical contact assembly may be comprised of an electrically conductive contact sleeve and an electrically conductive contact member slidably engaged with the contact sleeve, wherein the contact sleeve and the contact member are capable of relative reciprocable movement. One of the contact sleeve and the contact member may be electrically connected with the housing electrical conductor and the other of the contact sleeve and the contact member may be electrically connected with the shaft electrical conductor.

The contact sleeve and the contact member may define a contact chamber. The reciprocable contact assembly may be further comprised of an electrically conductive contact spring. The contact spring may be contained in the contact chamber such that the contact spring is engaged with both the contact sleeve and the contact member.

The assimilating connector may be further comprised of a dampening mechanism for dampening the relative longitudinal movement of the shaft conductor and the housing conductor.

The transverse movement assimilating connector may be comprised of an extension member which extends between the housing conductor and the shaft conductor. The extension member may be comprised of a flexible shaft. Where the conducting path is comprised of an electrical conducting path, the extension member may be comprised of an electrically conductive extension member, which may be comprised of a flexible shaft.

The assimilating connector may be further comprised of an extension member interposed between the housing conductor and the shaft conductor so that the extension member is conductively connected with both the housing conductor and the shaft conductor. The extension member may be comprised of a flexible shaft.

Where the assimilating connector is comprised of the transverse movement assimilating connector, the transverse movement assimilating connector may be comprised of the extension member, which may be comprised of a flexible shaft.

Where the conductive path is comprised of an electrical conducting path, the extension member may be comprised of an electrically conductive extension member.

Where the assimilating connector is comprised of the bearing assembly and where the assimilating connector is further comprised of the extension member, the bearing assembly may be interposed between the extension member and one of the housing conductor and the shaft conductor. In a preferred embodiment where the conductive path is comprised of an electrical conducting path, the bearing assembly is interposed between the housing electrical conductor and an electrically conductive extension member.

Where the assimilating connector is comprised of the reciprocable contact assembly and where the assimilating connector is further comprised of the extension member, the reciprocable contact assembly may be interposed between the extension member and one of the housing conductor and the shaft conductor. In a preferred embodiment where the conductive path is comprised of an electrical conducting path, the reciprocable contact assembly is interposed between the shaft electrical conductor and an electrically conductive extension member.

In a second aspect, the invention is an assimilating connector for interposing between a first electrical conductor and a second electrical conductor in order to electrically connect the first electrical conductor with the second electrical conductor and in order to assimilate a rotary movement of the first electrical conductor relative to the second electrical conductor, the assimilating connector comprising a bearing assembly, wherein the bearing assembly is comprised of a bearing electrical path through the bearing assembly for electrically connecting the first electrical conductor and the second electrical conductor with each other.

In the second aspect of the invention, the assimilating connector may be associated with any apparatus which comprises a first electrical conductor and a second electrical conductor which may experience a relative rotary movement.

In the second aspect of the invention, the assimilating connector is comprised of a rotary movement assimilating connector, which rotary movement assimilating connector may be further comprised of the features described with respect to the rotary movement assimilating connector according to the first aspect of the invention.

In the second aspect of the invention, the first electrical conductor and the second electrical conductor are analogous to the housing electrical conductor and the shaft electrical conductor respectively as described with respect to the first aspect of the invention.

In a third aspect, the invention is an assimilating connector for interposing between a first conductor and a second conductor in order to conductively connect the first conductor with the second conductor and in order to assimilate a movement of the first conductor relative to the second conductor, the assimilating connector comprising:

(a) a rotary movement assimilating connector for assimilating a rotary movement of the first conductor relative to the second conductor;

(b) a longitudinal movement assimilating connector for assimilating a longitudinal movement of the first conductor relative to the second conductor; and (c) a transverse movement assimilating connector for assimilating a transverse movement of the first conductor relative to the second conductor.

In the third aspect of the invention, the assimilating connector may be associated with any apparatus which comprises a first conductor and a second conductor which may experience a relative movement.

In the third aspect of the invention, the assimilating connector is comprised of a rotary movement assimilating connector, which rotary movement assimilating connector may be further comprised of the features described with respect to the rotary movement assimilating connector according to the first aspect of the invention.

In the third aspect of the invention, the assimilating connector is further comprised of a longitudinal movement assimilating connector, which longitudinal movement assimilating connector may be further comprised of the features described with respect to the longitudinal movement assimilating connector according to the first aspect of the invention.

In the third aspect of the invention, the assimilating connector is further comprised of a transverse movement assimilating connector, which transverse movement assimilating connector may be further comprised of the features described with respect to the transverse movement assimilating connector according to the first aspect of the invention.

In the third aspect of the invention, the first conductor and the second conductor are analogous to the housing conductor and the shaft conductor respectively as described with respect to the first aspect of the invention.

BRIEF DESCRIPTION OF DRAWINGS

Embodiments of the invention will now be described with reference to the accompanying drawings, in which.

DETAILED DESCRIPTION

Figure 1:
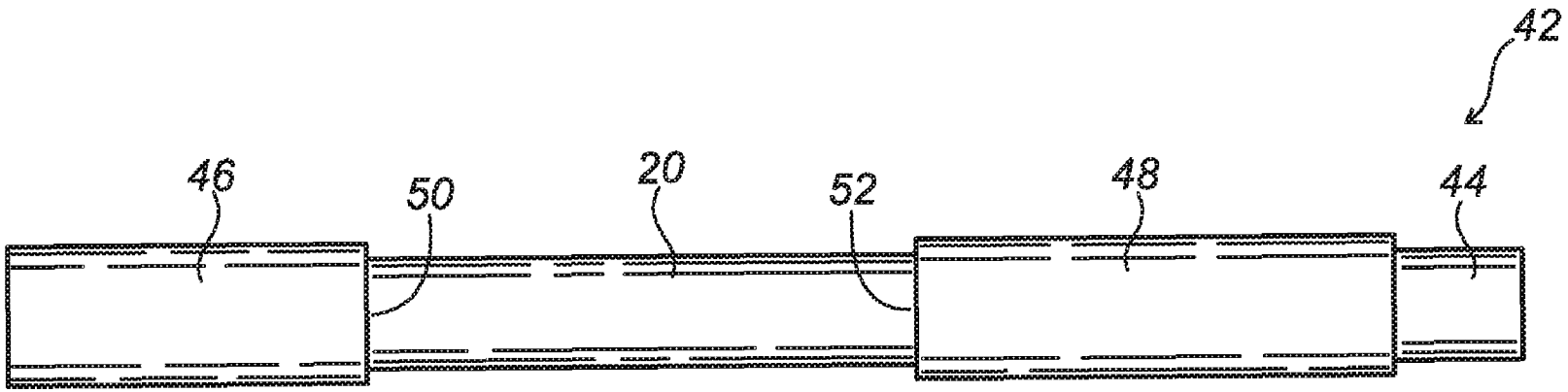
FIG. 1 is a side schematic drawing of a preferred configuration of a drilling string including the downhole drilling motor of the within invention.

Referring to FIGS. 1-5, the present invention is directed at a downhole drilling motor (20) comprised of a housing (22) and a shaft (24). The shaft (24) extends within the housing (22) and is movable relative to the housing (24). Further, the drilling motor (20) is comprised of a conducting path (26) which extends within the housing (24) between a first axial position (28) and a second axial position (30).

In the preferred embodiment, the conducting path (26) is comprised of an assimilating connector (32), a first conductor (34) and a second conductor (36). The assimilating connector (32) is provided for conductively connecting the first conductor (34) and the second conductor (36), wherein the conductors (34, 36) are capable of a movement relative to each other. More particularly, the assimilating connector (32) is interposed between the first and second conductors (34, 36) for conductively connecting the conductors (34, 36) and for assimilating the relative movement of the conductors (34, 36). The relative movement of the conductors (34, 36) may be comprised of a rotary movement, a longitudinal movement, a transverse movement, or combinations thereof.

As indicated, in the preferred embodiment, the conducting path (26) comprises a part or component of a drilling motor (20). Accordingly, the first conductor (34) is preferably associated with one of the housing (22) and the shaft (24), while the second conductor (36) is preferably associated with the other of the housing (22) and the shaft (24). In the preferred embodiment, the first conductor (34) is associated with the housing (22) and is also referred to herein as the housing conductor (38). Further, in the preferred embodiment, the second conductor (36) is associated with the shaft (24) and is also referred to herein as the shaft conductor (40). Thus, the assimilating connector (32) is interposed between the housing conductor (38) and the shaft conductor (40) for conductively or electrically connecting the housing conductor (38) and the shaft conductor (40).

The conducting path (26), including the assimilating connector (32), is provided to facilitate the transmission of power and/or communication signals within or through the downhole drilling motor (20). The conducting path-(26) may be used to communicate power or communication signals along or through any length or portion of the drilling motor (20) and may be used to communicate power or communication signals within the drilling motor (20) either from the first axial position (28) to the second axial position (30) or from the second axial position (30) to the first axial position (28). Preferably, the conducting path (26) may be used to communicate power and/or communication signals in both directions within the drilling motor (20) so that the power and/or communication signals can be communicated either toward the surface or away from the surface of a borehole in which the drilling motor (20) is contained.

Information communicated toward the surface using the conducting path (26) may typically relate to drilling operations or to the environment in which drilling is taking place, such as for example weight-on-bit, natural gamma ray emissions, borehole inclination, borehole pressure, mud cake resistivity and so on. Information communicated away from the surface using the conducting path (26) may typically relate to instructions sent from the surface, such as for example a signal from the surface prompting the drilling motor (20) or another downhole tool or other downhole equipment to send information back to the surface or instructions from the surface to alter drilling operations of the drilling motor (20). Further, the conducting path (26) may transmit power from the surface to the drilling motor (20) or to a downhole tool or other downhole equipment. Alternately, the conducting path (26) may transmit power from a downhole location towards the surface.

In the preferred embodiment, the power and/or communication signals are electrical signals. Thus, in the preferred embodiment, the drilling motor (20) provides an electrical conducting path (26). Accordingly, the electrical conducting path (26) transmits electrical power and/or communication signals between the first axial position (28) and the second axial position (30). Further, the first and second conductors (34, 36), and accordingly the housing conductor (38) and the shaft conductor (40) respectively, are preferably electrical conductors. Thus, the assimilating connector (32) electrically connects the first electrical conductor (34), also referred to herein as the housing electrical conductor (38), with the second electrical conductor (36), also referred to herein as the shaft electrical conductor (40).

In the preferred embodiment, the downhole motor (20) is used as a part or component of a drill string, and preferably a bottom hole assembly (42) as shown in FIG. 1 at or near the downhole end of the drill string. Further, the downhole motor (20) is operatively associated or connected with a drill bit (44) such that the motor (20) actuates the drill bit (44) to drill a borehole.

In addition, the bottom hole assembly (42) preferably includes a downhole telemetry system (46). In this instance, the downhole motor (20) is preferably positioned or located within the bottom hole assembly (42) between the telemetry system (46) and the drill bit (44). Finally, the bottom hole assembly (42) may include one or more further downhole tools or components, such as a rotary steerable tool or rotary steerable drilling assembly (48). Any such further downhole tools or components, including the rotary steerable drilling assembly (48), are preferably positioned or located within the bottom hole assembly (42) downhole of the drilling motor (20), such as between the drilling motor (20) and the drill bit (44). However, alternately, where desired or required for the proper operation of the bottom hole assembly (42), the further downhole tools or components may be located uphole of the drilling motor (20).

In any event, further downhole tools or components may include one or more of a stabilizer, a collapsible stabilizer, an adjustable stabilizer, a reamer, an underreamer, a sensor, including a measurement-while-drilling ("MWD") sensor or a logging-while-drilling ("LWD") sensor, a battery pack or power generation system, a formation pressure tester, a varying or fixed magnetic or electric field generator or an acoustic transmitter.

As a result, the conducting path (26) of the present invention which extends within or through the drilling motor (20) permits or provides for the transmission or communication of power and/or communication signals across the drilling motor (20) between the other components of the bottom hole assembly (42). Thus, for instance, power and/or communication signals may be transmitted or communicated between the telemetry system (46) uphole of the drilling motor (20) and the rotary steerable drilling assembly (48) and/or the drill bit (44) downhole of the drilling motor (20).

The telemetry system (46) may be comprised of any known or conventional borehole telemetry system or surface communication system, such as a known or conventional MWD system, which is capable of providing power and/or communications to and from the surface during drilling operations and which is compatible for use with the drilling motor (20). In the preferred embodiment, the telemetry system (46) is a positive pulse MWD telemetry system, such as that manufactured by Halliburton Energy Services, Inc. under the trademark GeoSpan™.

Further, the rotary steerable drilling assembly (48) may be comprised of any known or conventional rotary steerable tool compatible with the drilling motor (20). However, in the preferred embodiment, the rotary steerable drilling assembly (48) is the rotary steerable tool described in U.S. Pat. No. 6,244,361 issued on Jun. 12, 2001 and manufactured by Halliburton Energy Services, Inc. under the trade-mark GeoPilot™.

The drill bit (44) may be comprised of any type or configuration of drill bit suitable for performing the desired drilling operation and which is compatible with the downhole drilling motor (20). For example, the drill bit (44) may be comprised of a polycrystalline diamond cutter ("PDC") bit, a roller cone bit, a long or extended gauge bit, a bit having straight or spiral blades or any other bit configuration compatible with the drilling operation to be performed. Additionally, the drill bit (44) may be comprised of a single integral member or element or it may be comprised of a plurality of members or elements connected, mounted or fastened together in any manner to provide the desired drill bit (44). In the preferred embodiment, the drill bit (44) is an extended gauge bit.

In this preferred embodiment, the drill string is rotated from the surface, but only at a sufficient RPM (rotations per minute) to break or overcome the bonds of static friction. The actual drilling operation is preferably performed by the drilling motor (20). It is believed that the rotation of the drill string in combination with the drilling motor (20) may increase the total RPM of the drill bit (44), particularly in more difficult formations. Further, given that power to the drill bit (44) is supplied primarily from the drilling motor (20), the rotation required from the surface may be reduced. Accordingly, wear on the casing of the borehole may be reduced. As well, an improved transmission of power to the drill bit (44) may reduce vibration of the drilling motor (20) caused by stick-slip of the drill bit (44).

Referring to FIG. 2, the downhole drilling motor (20) according to a preferred embodiment of the present invention is shown. The drilling motor (20) has an upper or proximal end (50) and an opposed lower or distal end (52) and in the preferred embodiment is comprised of a number of components connected together. Beginning at the proximal end (50) and moving toward the distal end (52), the drilling motor (20) includes an upper sub (54), an upper flex sub (56), a power unit (58), a transmission unit (60) and a bearing sub (62), all preferably removably connected end to end with threaded connections.

The power unit (58) of the drilling motor (20) generates the power provided by the drilling motor (20) to rotate the drill bit (44). In the preferred embodiment, as described in detail below, the power unit (58) is comprised of a progressing cavity assembly.

The drilling motor (20) may be made up of a single component or a plurality of components other than those described for the preferred embodiment of the invention. In addition, the components of the drilling motor (20) may be connected together other than by using threaded connections. For example, some or all of the components may be connected by welding or with splined connections.

During drilling operations, the drill bit (44) or a drill bit assembly may be directly connected with the distal end (52) of the drilling motor (20). However, in the preferred embodiment, the drill bit (44) or drill bit assembly is located below or downhole of the distal end (52) of the drilling motor (20), but is indirectly connected therewith by one or more intervening tools or components of the bottom hole assembly (42). Specifically, the rotary steerable drilling assembly (48) is connected with the distal end (52) of the drilling motor (20), which is in turn directly or indirectly connected with the drill bit (44). The proximal end (50) of the drilling motor (20) is connected to the remainder of the drill string or other components of the bottom hole assembly (42). In the preferred embodiment, the proximal end (50) of the drilling motor (20) is connected with the telemetry system (46), preferably by a threaded connection.

As indicated, the downhole drilling motor (20) is comprised of the housing (22) and the shaft (24). The shaft (24) extends within the housing (22) and is supported such that the shaft (24) is movable within the housing (22). In particular, the shaft (24) is capable of rotary movement within the housing (22). Thus, the shaft (24) is rotatably supported within the housing (22). However, upon rotation of the shaft (24), the shaft (24) also undergoes or is capable of or subjected to both longitudinal movement and transverse movement. Longitudinal movement is movement of the shaft (24) relative to the housing (22) in an axial direction along or parallel with a longitudinal axis of the shaft (24). Transverse movement is a movement of the shaft (24) relative to the housing (22) in a radial direction perpendicular with or transverse to the longitudinal axis of the shaft (24).

Referring to FIG. 2, in the preferred embodiment, the shaft (24) and the housing (22) of the drilling motor (20) are made up one or more of the components of the upper sub (54), the upper flex sub (56), the power unit (58), the transmission unit (60) and the bearing sub (62).

More particularly, the shaft (24) extends from an upper or proximal end (64) within the power unit (58) to a lower or distal end (66) extending from the bearing sub (62). Beginning at the distal end (66) of the shaft (24) of the drilling motor (20), the distal end (66) of the shaft (24) is comprised of a drive shaft (68). Specifically, the drive shaft (68) includes a distal end (70) which is adapted to be connected to the rotary steerable drilling assembly (48), a drill bit assembly or other desired downhole equipment.

As discussed above, the bottom hole assembly (42) may be further comprised of one or more subs, tools or further equipment preferably connected between the distal end (70) of the drive shaft (68) and the drill bit (44), such as a stabilizer, collapsible stabilizer, adjustable stabilizer, reamer, underreamer, sensor, telemetry system, formation pressure tester, varying or fixed magnetic or electric field generator or acoustic transmitter.

Further, at least one sensor (not shown) may be located downhole of the distal end (70) of the drive shaft (68) so that the sensor can provide information relating to downhole conditions or drilling parameters to the surface through the drilling motor (20). More particularly, each sensor may be comprised of any sensor or sensing equipment, or combination of sensors or sensing equipment, which is capable of sensing and generating information regarding a desired downhole condition, drilling motor (20) condition or drilling parameter. For example, the sensor may provide information concerning one or more of the following: characteristics of the borehole or the surrounding formation including natural gamma ray, resistivity, density, compressional wave velocity, fast shear wave velocity, slow shear wave velocity, dip, radioactivity, porosity, permeability, pressure, temperature, vibration, acoustic, seismic, magnetic field, gravity, acceleration (angular or linear), magnetic resonance characteristics or fluid flow rate, pressure, mobility, or viscosity characteristics of a fluid within the borehole or the surrounding formation; drilling characteristics or parameters including the direction, inclination, azimuth, trajectory or diameter of the borehole or the presence of other proximate boreholes; and the condition of the drill bit (44) or other components of the drilling motor (20) including weight-on-bit, drill bit temperature, torque on bit or the differential pressure across the bit.

A proximal end (72) of the drive shaft (68) is threadably connected to a distal end (74) of a drive shaft cap (76). A proximal end (78) of the drive shaft cap (76) is threadably connected to a lower coupling (80). The lower coupling (80) is connected with a distal end (82) of a transmission shaft (84). A proximal end (86) of the transmission shaft (84) is connected with an upper coupling (88). The upper coupling (88) is threadably connected to a distal end (90) of a rotor (92). A proximal end (94) of the rotor (92) defines the proximal end (64) of the shaft (24) and is connected with the assimilating connector (32) as described further below.

The lower coupling (80) and the upper coupling (88) may be comprised of any type or configuration of coupling or connecting mechanism capable of and suitable for operatively engaging the adjacent components comprising the shaft (24). Further, as described in detail below, the lower coupling (80) and the upper coupling (88) are adapted to permit a conductive member, such as an electrical wire, to pass or feed therethrough. In the preferred embodiment, the transmission shaft (84) is comprised of a flexshaft. The flexshaft is also adapted to permit a conductive member, such as an electrical wire, to pass or feed therethrough.

Therefore, in the preferred embodiment, the lower coupling (80) and the upper coupling (88) are both comprised of a flexshaft assembly for operatively connecting the distal and proximal ends (82, 86) of the transmission shaft (84) with the drive shaft cap (76) and the rotor (92) respectively. More particularly, the lower coupling (80) and the upper coupling (88) are both comprised of a feed through flexshaft assembly permitting the conductive member or electrical wire to pass or feed between and through the transmission shaft (84) and the couplings (80, 88) such that the conductive member or electrical wire may pass through the entire shaft (24).

In summary, in the preferred embodiment, the shaft (24) is comprised of the drive shaft (68), the drive shaft cap (76), the lower coupling (80), the transmission shaft (84), the upper coupling (88) and the rotor (92).

The housing (22) of the drilling motor (20) also extends from an upper or proximal end (96) associated with the upper sub (54) to a lower or distal end (98) associated with the bearing sub (62). Beginning at the distal end (98) of the housing (22), the housing (22) includes a drive shaft catcher nut (100). The drive shaft catcher nut (100) has a distal end (102) from which the drive shaft (68) extends or protrudes. A proximal end (104) of the drive shaft catcher nut (100) is threadably connected with a distal end (106) of a lower bearing housing (108), which comprises the bearing sub (62). A proximal end (110) of the lower bearing housing (108) is threadably connected to a distal end (112) of an upper bearing housing (114), which also comprises the bearing sub (62).

A proximal end (116) of the upper bearing housing (114) is threadably connected to a distal end (118) of a transmission unit housing (120), which comprises the transmission unit (60). A proximal end (122) of the transmission unit housing (120) is threadably connected to a distal end (124) of a power unit housing (126), which comprises the power unit (58). The power unit housing (126) comprises the stator of the progressing cavity assembly. A proximal end (128) of the power unit housing (126) is threadably connected to a distal end (130) of an upper flex sub housing (132), which comprises the upper flex sub (56). A proximal end (134) of the upper flex sub housing (132) is threadably connected to a distal end (136) of an upper sub housing (138), which comprises the upper sub (54).

A proximal end (140) of the upper sub housing (138) includes a threaded connection defining the proximal end (50) of the drilling motor (20) which is connected with the remainder of the bottom hole assembly (42) and drill string (20), particularly the telemetry system (46). The assimilating connector (32) is associated with and substantially contained within the upper sub housing (138), the upper flex sub housing (132) and the proximal end (128) of the power unit housing (126). Further, the drilling motor (20) defines a fluid pathway (142) therethrough from the proximal end (50) to the distal end (52) of the drilling motor (20).

In summary, in the preferred embodiment, the housing (22) is comprised of the drive shaft catcher nut (100), the lower bearing housing (108), the upper bearing housing (114), the transmission unit housing (120), the power unit housing (126), the upper flex sub housing (132) and the upper sub housing (138).

In addition, as indicated, the shaft (24) is movably supported within the housing (22). As described, the proximal end (104) of the drive shaft catcher nut (100) is threadably connected with the distal end (106) of the lower bearing housing (108). The drive shaft catcher nut (100) surrounds the drive shaft (68) as it exits the distal end (98) of the housing (22) and contains a split ring (144) in an annular space between the drive shaft catcher nut (100) and the drive shaft (68). Preferably, the drive shaft (68) includes an outwardly extending shoulder (146) which cooperates with the split ring (144) to assist with maintaining the longitudinal position of the drive shaft (68) within the housing (22).

Further, the bearing sub (62) includes the lower bearing housing (108), which is threadably connected with the drive shaft catcher nut (100), and the upper bearing housing (114), which is threadably connected with the lower bearing housing (108). The lower and upper bearing housings (108, 114) surround the drive shaft (68) and contain a bearing assembly (148) in an annular space between the lower and upper bearing housings (108, 114) and the drive shaft (68). The bearing assembly (148) may be comprised of one type or a combination of types of bearings including radial and thrust bearings.

In the preferred embodiment, the bearing assembly (148) is comprised of a lower radial bearing (150), one or more thrust bearings (152) and an upper radial bearing (154). The lower radial bearing (150) is contained within the lower bearing housing (108) and functions to rotatably support the drive shaft (68) in the lower bearing housing (108). The upper radial bearing (154) is contained within the upper bearing housing (114) and functions to rotatably support the drive shaft cap (76) in the upper bearing housing (114).

The thrust bearings (152) are contained within the upper bearing housing (114) and function to axially support the drive shaft (68) in the upper bearing housing (114). Further, the bearing assembly (148) preferably includes a mechanism for preloading (156) the thrust bearings (152). Any compatible or suitable preloading mechanism (156) may be used for the thrust bearings (152). In the preferred embodiment, the thrust bearings (152) are positioned longitudinally between the distal end (74) of the drive shaft cap (76) and the proximal end (110) of the lower bearing housing (108). Further, the preloading mechanism (156) is positioned between the distal end (74) of the drive shaft cap (76) and the thrust bearings (152) such that the preloading mechanism (156) urges the thrust bearings (152) away from the drive shaft cap (76) and into contact with the proximal end (110) of the lower bearing housing (108) to apply a desired preload force. The preloading mechanism (156) is preferably comprised of one or more springs (158) suitable for applying the desired preload force to the thrust bearings (152).

The drilling motor (20) provides the conducting path (26) which extends within the housing (22) between the first axial position (28) and the second axial position (30). The axial positions (28, 30) may be located at any positions or locations within the housing (22), including any components of the housing (22) as described above. However, in the preferred embodiment, the conducting path (26) is provided through the entire drilling motor (20) such that power and communication signals may be transmitted therethrough in either direction along the bottom hole assembly (42) and the drill string. Accordingly, one of the first and second axial positions (28, 30) is preferably positioned or located adjacent the proximal end (50) of the drilling motor (20), while the other of the first and second axial positions (28, 30) is preferably positioned or located adjacent the distal end (52) of the drilling motor (20). For ease of reference, the axial position adjacent the proximal end (50) of the drilling motor (20) will be referred to herein as the first axial position (28), while the axial position adjacent the distal end (50) of the drilling motor (20) will be referred to herein as the second axial position (30).

Further, as discussed above, the conducting path (26) is preferably an electrical conducting path. Therefore, the conducting path (26) permits or provides for the transmission of electrical signals between the first and second axial positions (28, 30). More particularly, the invention is directed at communicating power and/or information or data between the axial positions (28, 30) by conducting or transmitting the electrical signal through the conducting path (26) between the axial positions (28, 30).

Preferably, the electrical signal is comprised of any varying electrical signal, including unipolar alternating current (AC) signals, bipolar AC signals and varying direct current (DC) signals. The electrical signal may vary as a wave, pulse or in any other manner. For instance, the electrical signal may be a modulated signal which embodies the information to be communicated. In this instance, the electrical signal may be modulated in any manner, such as for example by using various techniques of amplitude modulation, frequency modulation and phase modulation. Pulse modulation, tone modulation and digital modulation techniques may also be used to modulate the electrical signal.

Further, the drilling motor (20) may be comprised of more than one conducting path (26) in order to provide more than one "channel" to facilitate the transmission of power and/or communication electrical signals, either separately or concurrently. However, for illustration purposes, a single conducting path (26) is shown in the Figures and described herein. It should however be understood that the within invention is not limited to the use of a single conducting path (26). For example, different conducting paths may be provided to transmit power, to transmit information or data, to receive information or data and to act as a ground. Where one conducting path (26) is provided, the single conducting path (26) is utilized to individually or concurrently transmit power, as well as transmit and receive information or data. A ground need not be specifically provided. Rather, the surrounding formation and/or the housing (22) may act as the ground or provide the "return path" for the electrical signal.

Referring to FIG. 2, in the preferred embodiment, the electrical conducting path (26) is comprised of the housing electrical conductor (38), the shaft electrical conductor (40) and the assimilating connector (32) interposed therebetween for electrically connecting the housing electrical conductor (38) with the shaft electrical conductor (40) and for assimilating the movement of the shaft electrical conductor (40) relative to the housing electrical conductor (38).

The housing electrical conductor (38) may be comprised of conductive parts of the housing (22), electrical wire, electrical cable, fittings or combinations thereof, such that the housing electrical conductor (38) is associated with the housing (22). Preferably, the housing electrical conductor (38) is attached to or connected with the housing (22), particularly the upper sub housing (138), such that the housing electrical conductor (38) moves with the housing (22).

Figure 2A:
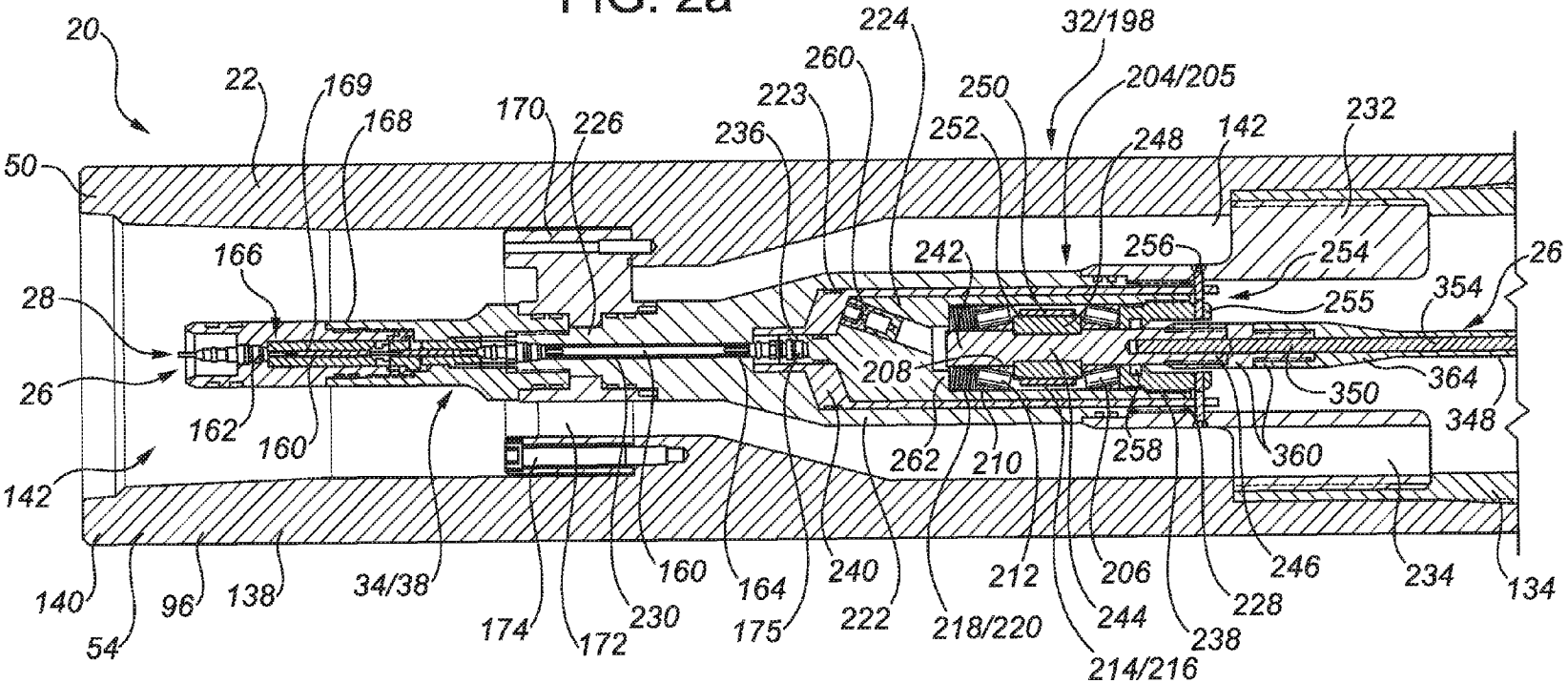
FIGS. 2*a* through 2*g* are longitudinal sectional views in sequence of a preferred embodiment of the downhole drilling motor of the within invention, as shown in FIG. 1, including a preferred embodiment of an assimilating connector, FIGS. 2*b* through 2*g* being lower continuations respectively of FIGS. 2*a* through 2*f;*

Referring to FIG. 2*a*, the housing electrical conductor (38), also referred to herein simply as the housing conductor or first conductor, is comprised of a housing conductive member (160). The housing conductive member (160) may be comprised of a single integral electrical cable or electrical wire or may be comprised of a plurality of electrical cables or electrical wires interconnected such that the housing conductive member (160) extends for a desired distance within the housing (22) of the drilling motor (20). In the preferred embodiment, the housing conductive member (160) is comprised of a plurality of electrical cables or wires interconnected by suitable electrical fittings or connectors.

Further, the housing conductive member (160) extends from a proximal end (162) to a distal end (164). The proximal end (162) of the housing conductive member (160) defines the first axial position (28) and is positioned adjacent the proximal end (140) of the upper sub housing (138) to facilitate the electrical connection of the housing conductive member (160) with the telemetry system (46). The distal end (164) of the housing conductive member (160) extends within the upper sub housing (138) for electrical connection with the assimilating connector (32), as discussed further below.

As well, in order to further facilitate the connection of the housing conductive member (160) with the telemetry system (46) or other components of the bottom hole assembly (42), the proximal end (162) of the housing conductive member (160) is preferably associated with an upper housing electrical connector (166). Preferably, the upper housing electrical connector (166) is comprised of a connector housing (168) defining a bore (169) which permits the housing conductive member (160) to extend therethrough. Further, the connector housing (168) is adapted to facilitate the connection of the housing conductive member (160) with a compatible conductive member in the telemetry system (46). If desired or necessary to facilitate the transmission of the electrical signals through the housing conductive member (160), an electrically insulative material may be provided within the bore (169) of the connector housing (168) to electrically insulate the housing conductive member (160) from the adjacent surface of the connector housing (168).

Any compatible known or conventional electrical connector may be utilized. However, preferably, the upper housing electrical connector (166) is adapted to provide a wet connection such that the electrical connection between the housing conductive member (160) and a compatible conductive member may be made downhole when fluid is present in the fluid pathway (142) of the drilling motor (20). Thus, the upper housing electrical connector (166) may include or be associated with one or more seals or sealing assemblies for sealing the housing conductive member (160) from the fluid pathway (142).

As stated, the housing conductor (38) is attached to or connected with the upper sub housing (138) such that the housing conductor (38) moves with the housing (22). In other words, preferably, the housing conductive member (160) is fixed within the upper sub housing (138). The housing conductive member (160) may be attached, connected or fixed in a desired position within the upper sub housing (138) by any compatible connecting mechanism or assembly. In the preferred embodiment, the upper housing electrical connector (166) is held in a desired position by a compatible hanger or centralizer (170).

The centralizer (170) is positioned within the fluid pathway (142) through the upper sub housing (138) and defines one or more channels (172) therethrough to permit the flow of fluid through the fluid pathway (142) relatively unimpeded. Further, the centralizer (170) is both fixedly connected or attached with the connector housing (168) and fixedly connected or attached with the upper sub housing (138) in order to hold or maintain the upper electrical connector (166) in the desired position. Thus, the upper electrical connector (166), and the housing conductive member (160) extending therein, move with the housing (22). The centralizer (170) may be fixedly or rigidly connected with the upper sub housing (138) in any manner either permanently, such as by welding, or removably, such as by one or more fasteners. Preferably, the centralizer (170) is removably or detachably connected with the upper sub housing (138) by one or more screws (174) or alternate fasteners.

Finally, in order to further facilitate the electrical connection of the distal end (164) of the housing conductive member (160) with the assimilating connector (32), the distal end (164) of the housing conductive member (160) is preferably associated with a lower housing electrical connector (175). Preferably, the lower housing electrical connector (175) is adapted to facilitate the connection of the housing conductive member (160) with a compatible conductive member in the assimilating connector (32). Any compatible known or conventional electrical connector may be utilized.

The shaft electrical conductor (40) may be comprised of conductive parts of the shaft (24), electrical wire, electrical cable, fittings or combinations thereof, such that the shaft electrical conductor (40) is associated with the shaft (24). Preferably, the shaft electrical conductor (40) is attached, fastened within or connected with one or more of the rotor (92), the transmission shaft (84), the drive shaft (68) and the interconnecting components thereof, all of which comprise the shaft (24), such that the shaft electrical conductor (40) moves with the shaft (24).

Referring to FIGS. 2*c*-2*g*, the shaft electrical conductor (40), also referred to herein as the shaft conductor or second conductor, is comprised of a shaft conductive member (176). The shaft conductive member (176) may be comprised of a single integral electrical cable or electrical wire or may be comprised of a plurality of electrical cables or electrical wires interconnected such that the shaft conductive member (176) extends for a desired distance through the shaft (24) of the drilling motor (20). In the preferred embodiment, the shaft conductive member (176) is comprised of a plurality of electrical cables or wires interconnected by suitable electrical fittings or connectors.

Further, the shaft (24) defines a continuous longitudinal bore (178), channel or groove therethrough extending between the proximal end (64) and the distal end (66) of the shaft (24). The shaft conductive member (176) extends through the bore (178) from a proximal end (180) to a distal end (182) of the shaft conductive member (176). The proximal end (180) of the shaft conductive member (176) is positioned adjacent the proximal end (64) of the shaft (24), being the proximal end (94) of the rotor (92), to facilitate the electrical connection of the shaft conductive member (176) with the assimilating connector (32). The distal end (182) of the shaft conductive member (176) is positioned adjacent the distal end (66) of the shaft (24), being the distal end (70) of the drive shaft (68), to facilitate the electrical connection of the shaft conductive member (176) with the rotary steerable drilling assembly (48) or other component of the bottom hole assembly (42).

Figure 2B:
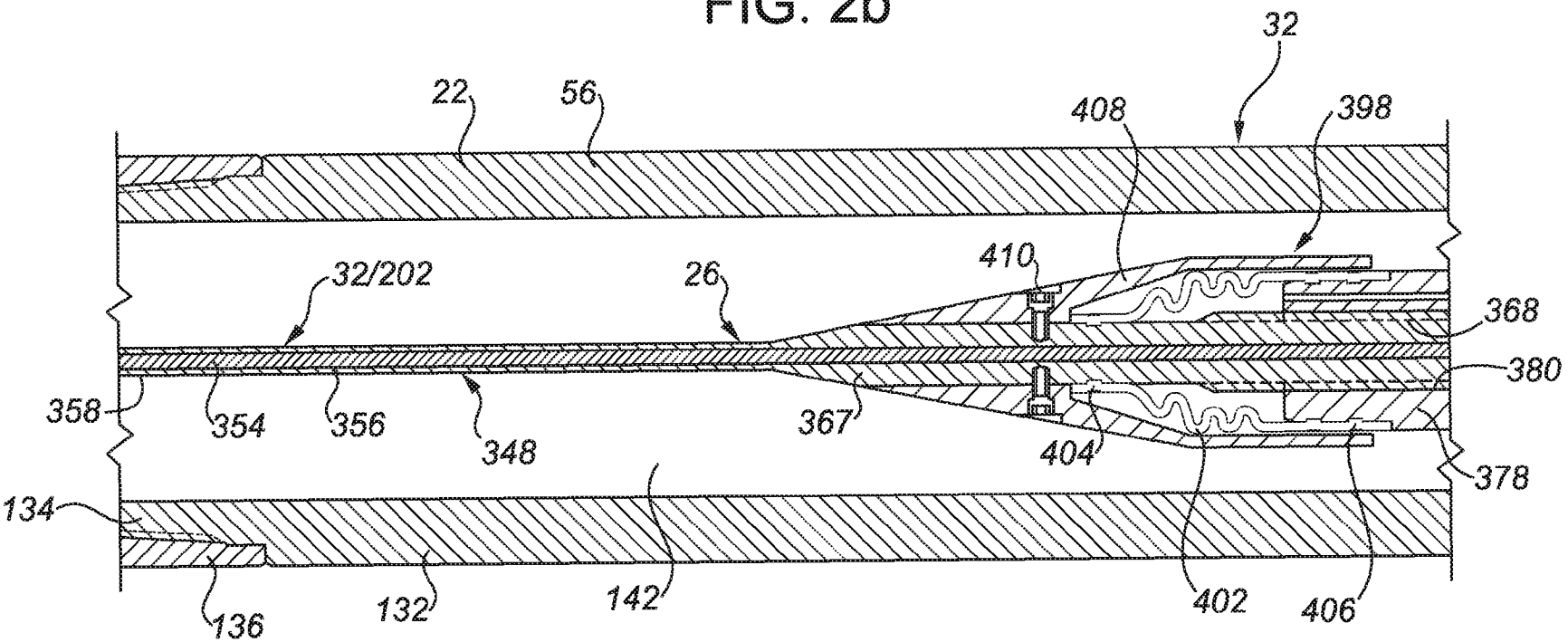
Figure 2C:
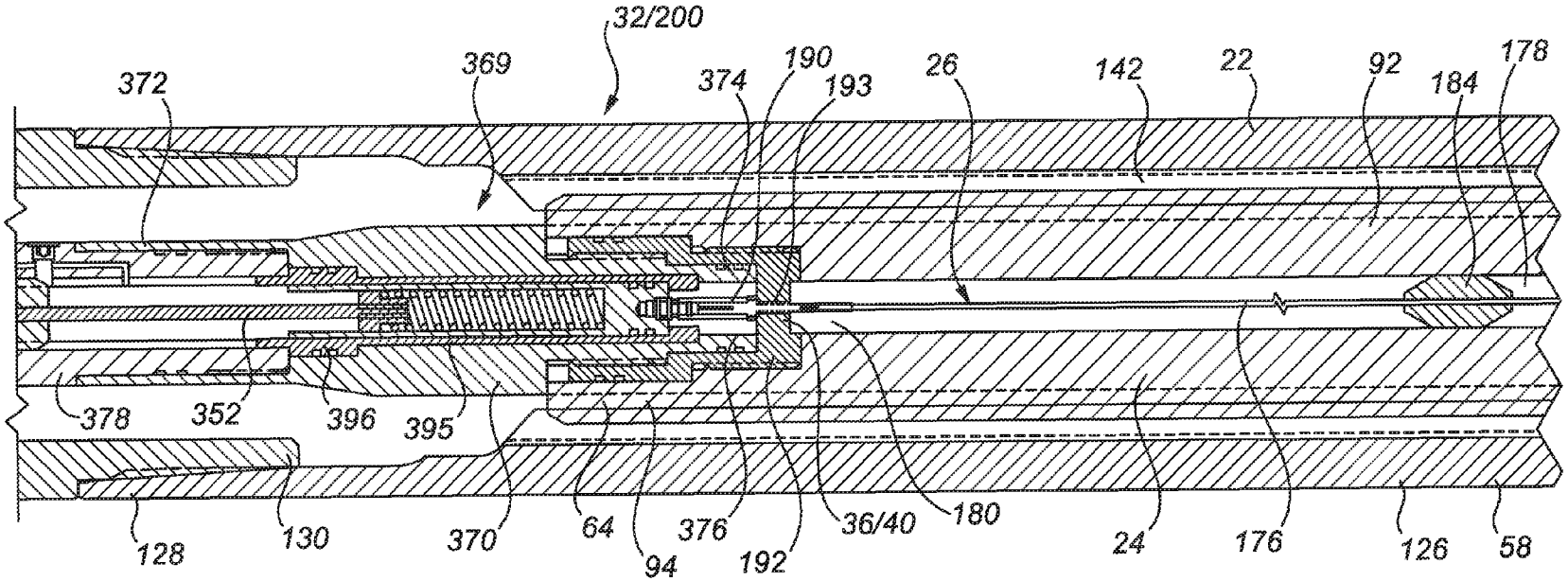
Figure 2D:
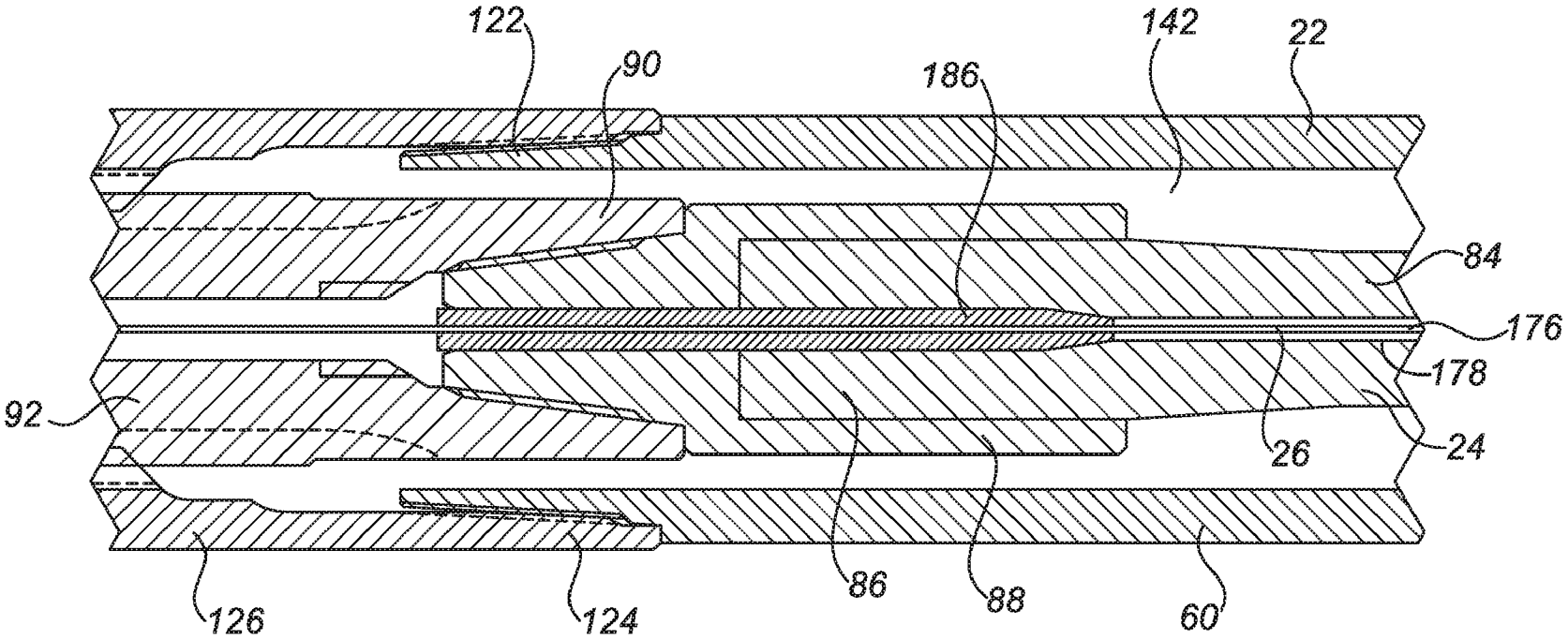

More particularly, referring to FIGS. 2*c*-2*d*, the rotor (92) defines a portion of the bore (178) therein for receipt of the shaft conductive member (176). The shaft conductive member (176) may be maintained in a relatively or substantially fixed position within the bore (178) by any suitable mechanism or process capable of holding or maintaining the desired positioning within the bore (178). For instance, as shown in FIG. 2*c*, one or more centralizers (184) may be used to mount the shaft conductive member (176) in a desired position within the bore (178) of the rotor (92). Further, if desired or necessary to facilitate the transmission of the electrical signals through the shaft conductive member (176), an electrically insulative material may be provided within the bore (178) of the rotor (92) to electrically insulate the shaft conductive member (176) from the adjacent surface of the rotor (92).

Alternatively, the bore (178) of the rotor (92) may be filled with a hardenable material following the placement of the shaft conductive member (176) therein. Accordingly, upon hardening of the material, the shaft conductive member (176) will be held in the desired position. In this case, the hardenable material is preferably comprised of an electrically insulative material such that the hardened material both maintains the position of the shaft conductive member (176) and insulates it from the surrounding rotor (92).

Figure 2E:
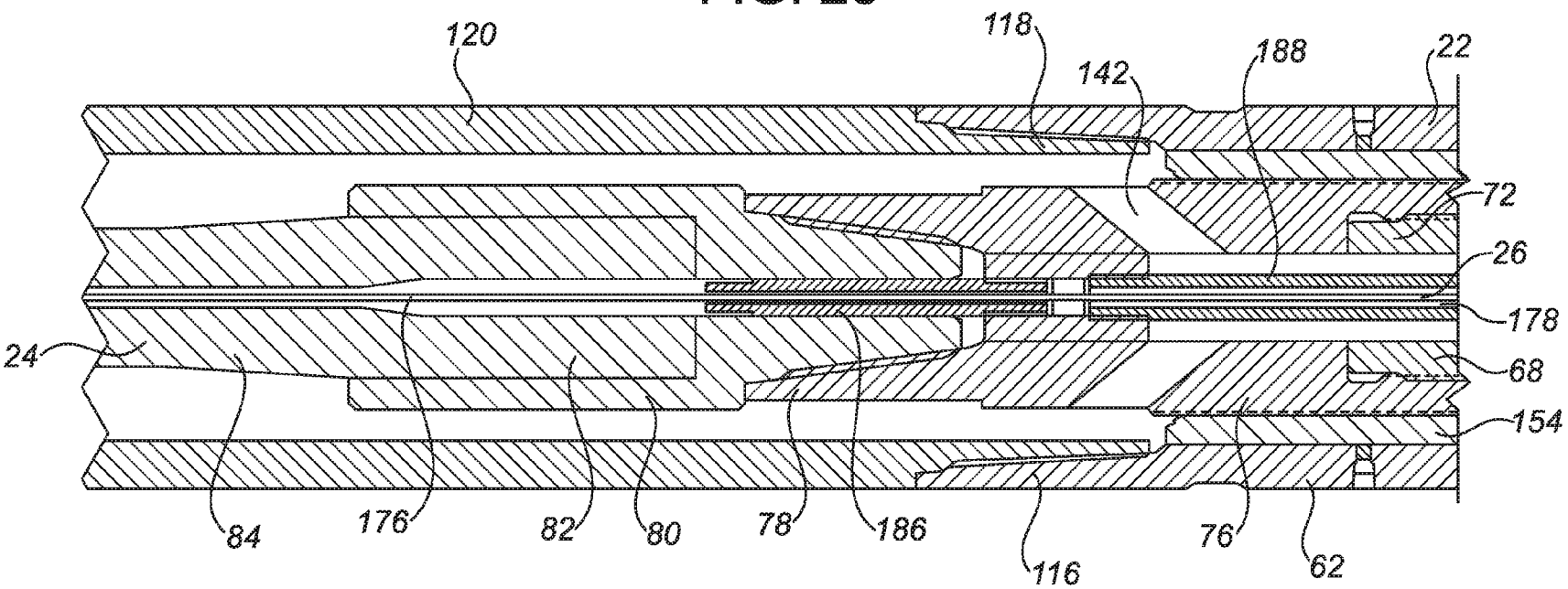

Referring next to FIGS. 2*d*-2*e*, the upper and lower couplings (88, 80) and the transmission shaft (84) extending therebetween all define a further portion of the bore (178) therein for receipt of the shaft conductive member (176). The shaft conductive member (176) may be maintained in a relatively or substantially fixed position within the bore (178) by any suitable mechanism or process capable of holding or maintaining the desired positioning within the bore (178). Further, if desired or necessary to facilitate the transmission of the electrical signals through the shaft conductive member (176), an electrically insulative material may be provided within the bore (178) through the upper and lower couplings (88, 80) and the transmission shaft (84) to electrically insulate the shaft conductive member (176) from the adjacent surfaces of the upper coupling (88), the lower coupling (80) and the transmission shaft (84). For instance, as shown in FIG. 2*d*, one or more insulative sleeves (186) may be provided along all or a portion of the shaft conductive member (176). Alternatively, if desired, an insulating hardenable material may similarly be used as described above for the rotor (92).

Figure 2F:
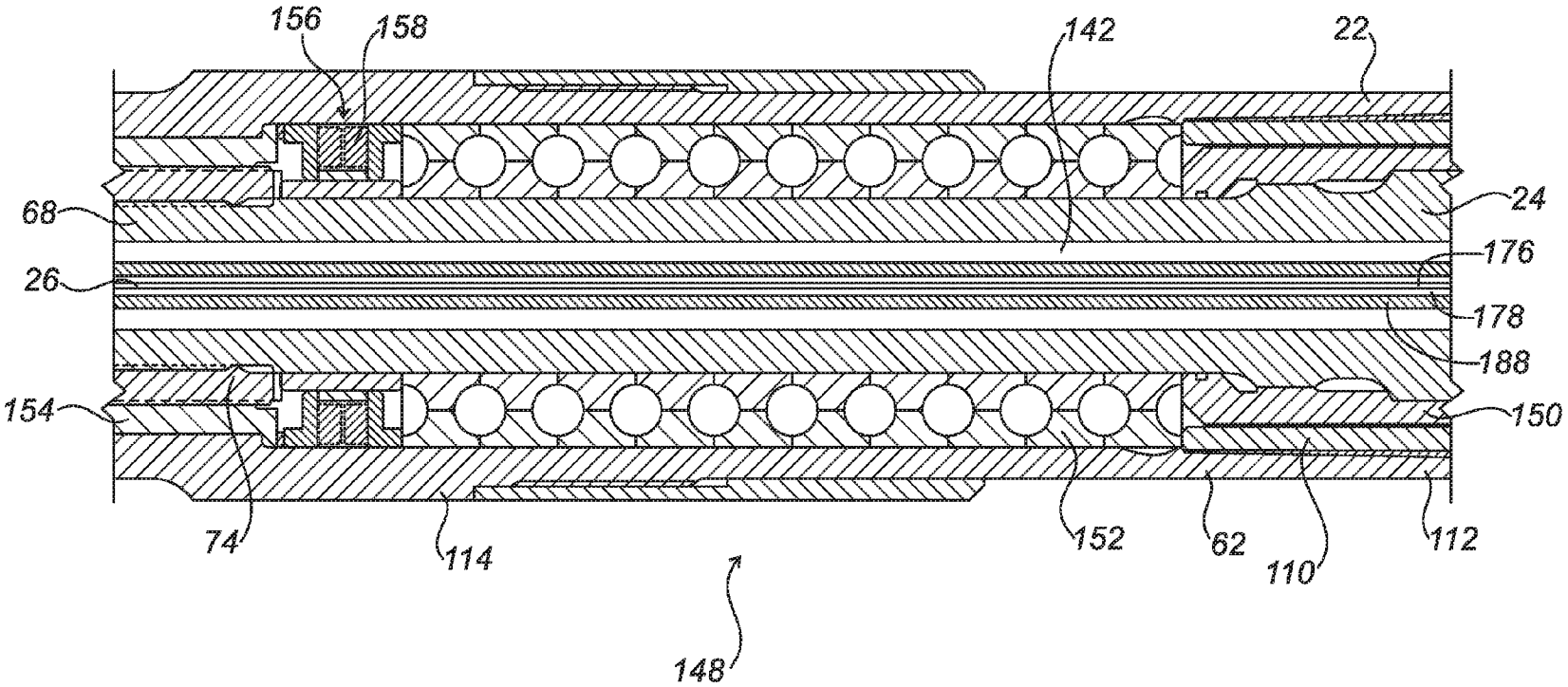
Figure 2G:
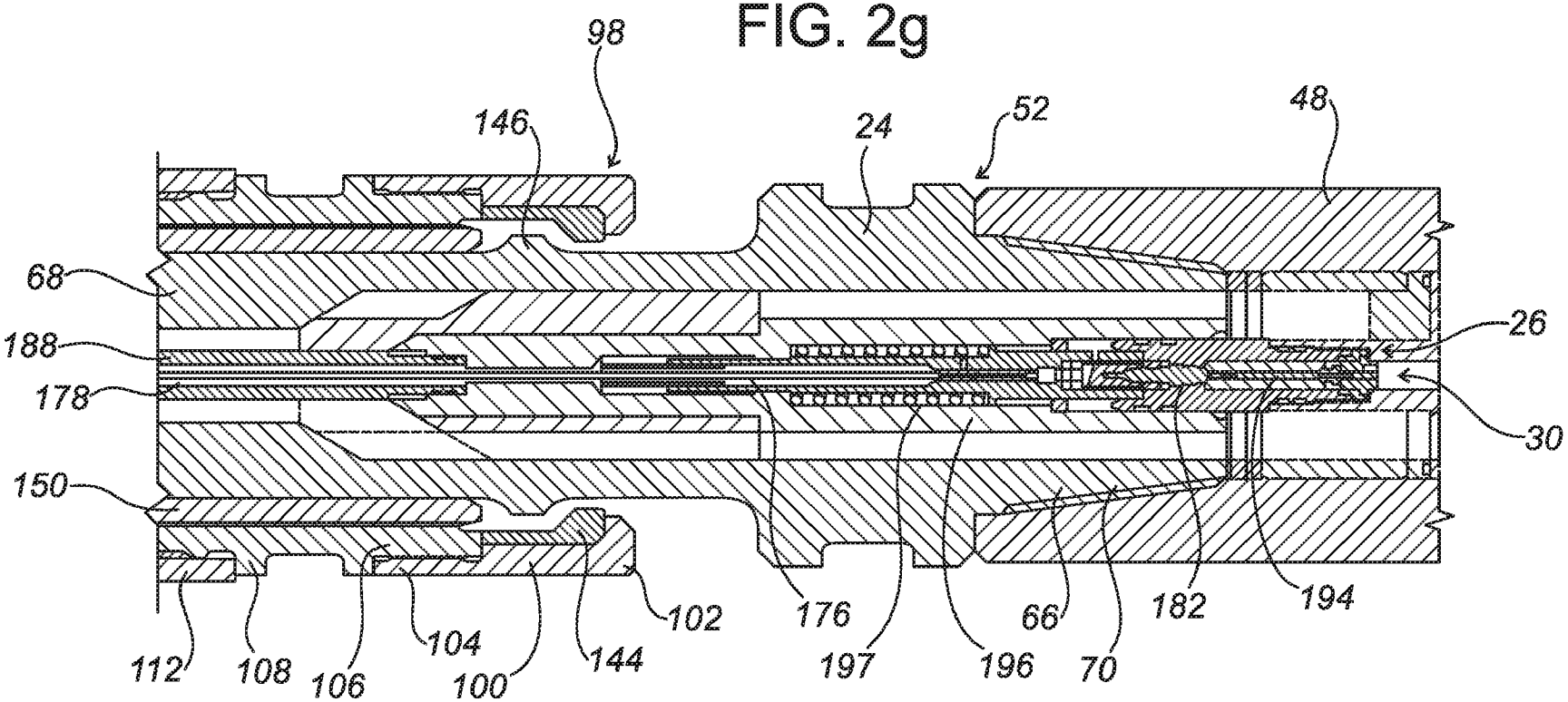

Referring next to FIGS. 2*e*-2*g*, the drive shaft cap (76) and the drive shaft (68) also define a further portion of the bore (178) therein for receipt of the shaft conductive member (176). The shaft conductive member (176) may be maintained in a relatively or substantially fixed position within the bore (178) by any suitable mechanism or process capable of holding or maintaining the desired positioning within the bore (178). For instance, if desired or required, one or more centralizers (not shown) may be used to maintain the shaft conductive member (176) in a desired position within the bore (178) of the drive shaft cap (76) and the drive shaft (68).

Further, if desired or necessary to facilitate the transmission of the electrical signals through the shaft conductive member (176), an electrically insulative material may be provided within the bore (178) through the drive shaft cap (76) and the drive shaft (68) to electrically insulate the shaft conductive member (176) from the adjacent surfaces of the drive shaft cap (76) and the drive shaft (68). For instance, as shown in FIGS. 2*e*-2*g*, an insulative sleeve (188), or plurality of insulative sleeves, may be provided along all or a portion of the shaft conductive member (176) through the drive shaft cap (76) and the drive shaft (68). Alternatively, if desired, an insulating hardenable material may similarly be used as described above for the rotor (92).

As well, in order to facilitate the electrical connection of the proximal end (180) of the shaft conductive member (176) with the assimilating connector (32), the proximal end (180) of the shaft conductive member (176) is preferably associated with an upper shaft electrical connector (190). Preferably, the upper shaft electrical connector (190) is comprised of a connector housing (192) or compatible electrical connection assembly defining a bore (193) which permits the shaft conductive member (176) to extend therethrough. Further, the connector housing (192) is adapted to facilitate the connection of the shaft conductive member (176) with a compatible conductive member in the assimilating connector (32). If desired or necessary to facilitate the transmission of the electrical signals through the shaft conductive member (176), an electrically insulative material may be provided within the bore (193) of the connector housing (192) to electrically insulate the shaft conductive member (176) from the adjacent surface of the connector housing (192). Any compatible known or conventional electrical connector may be utilized.

Similarly, in order to facilitate the connection of the distal end (182) of the shaft conductive member (176) with the rotary steerable drilling assembly (48) or other components of the bottom hole assembly (42), the distal end (182) of the shaft conductive member (176) is preferably associated with a lower shaft electrical connector (194). Preferably, the lower shaft electrical connector (194) is comprised of a connector housing (196) or compatible electrical connection assembly defining a bore (197) which permits the shaft conductive member (176) to extend therethrough. Further, the connector housing (196) is adapted to facilitate the connection of the shaft conductive member (176) with a compatible conductive member in the rotary steerable drilling assembly (48). If desired or necessary to facilitate the transmission of the electrical signals through the shaft conductive member (176), an electrically insulative material may be provided within the bore (197) of the connector housing (196) to electrically insulate the shaft conductive member (176) from the adjacent surface of the connector housing (196).

Once again, any compatible known or conventional electrical connector may be utilized. However, preferably, the lower shaft electrical connector (194) is adapted to provide a wet connection such that the electrical connection between the shaft conductive member (176) and a compatible conductive member may be made downhole when fluid is present in the fluid pathway (142) of the drilling motor (20). Thus, the lower shaft electrical connector (194) may include one or more seals or sealing assemblies for sealing the shaft conductive member (176) from the fluid pathway (142).

Finally, as stated, the shaft conductor (40) is preferably attached to, fastened within or connected with one or more of the rotor (92), the transmission shaft (84), the drive shaft (68) and the interconnecting components thereof, all of which comprise the shaft (24), such that the shaft conductor (40) moves with the shaft (24). More particularly, the shaft conductive member (176) comprising the shaft conductor (40) may be attached, connected or fixed in a desired position within the components of the shaft (24) by any compatible connecting mechanism or assembly, including one or more centralizers and/or insulative or supporting sleeves.

Further, the connector housings (192, 196) of each of the upper shaft electrical connector (190) and the lower shaft electrical connector (194) respectively are preferably mounted or fastened with the shaft (24). In particular, the connector housings (192, 196) are preferably fixedly or rigidly connected or fastened within the bore (178) of the shaft (24) in any manner either permanently, such as by welding, or removably, such as by a threaded engagement or the use of one or more fasteners. In the preferred embodiment, the connector housing (192) of the upper shaft electrical connector (190) is threadably engaged with or otherwise fixed within the bore (178) of the rotor (92) adjacent the proximal end (94) of the rotor (92). The connector housing (196) of the lower shaft electrical connector (194) is mounted or otherwise fixed within the bore (178) of the drive shaft (68) adjacent the distal end (70) of the drive shaft (68).

Thus, the housing conductor (38) is associated with the housing (22) and moves therewith. Similarly, the shaft conductor (40) is associated with the shaft (24) and moves therewith. Finally, the shaft (24) of the drilling motor (20) is movable relative to the housing (22). Thus, the shaft conductor (40) is movable relative to the housing conductor (38). The assimilating connector (32) is interposed or connected between the housing and shaft conductors (38, 40) to electrically connect the housing and shaft conductors (38, 40), while also assimilating or otherwise compensating, adapting or adjusting for the relative movement therebetween. In other words, the assimilating connector (32) is provided to facilitate or maintain the electrical contact between the housing and shaft conductors (38, 40) by adjusting, adapting or otherwise compensating for the movement of one of the housing and shaft conductors (38, 40) relative to the other of the housing and shaft conductors (38, 40).

Preferably, the assimilating connector (32) is comprised of one or more of a rotary movement assimilating connector (198), a longitudinal movement assimilating connector (200) and a transverse movement assimilating connector (202). In the preferred embodiment, the assimilating connector (32) is comprised of all of the rotary movement assimilating connector (198), the longitudinal movement assimilating connector (200) and the transverse movement assimilating connector (202).

The rotary movement assimilating connector (198) is provided for electrically connecting the shaft and housing conductors (40, 38) while assimilating the rotary movement of the shaft conductor (40) relative to the housing conductor (38). The longitudinal movement assimilating connector (200) is provided for further electrically connecting the shaft and housing conductors (40, 38) while assimilating the longitudinal movement of the shaft conductor (40) relative to the housing conductor (38). Finally, the transverse movement assimilating connector (202) is also provided for electrically connecting the shaft and housing conductors (40, 38) while assimilating the transverse movement of the shaft conductor (40) relative to the housing conductor (38).

Figure 3:
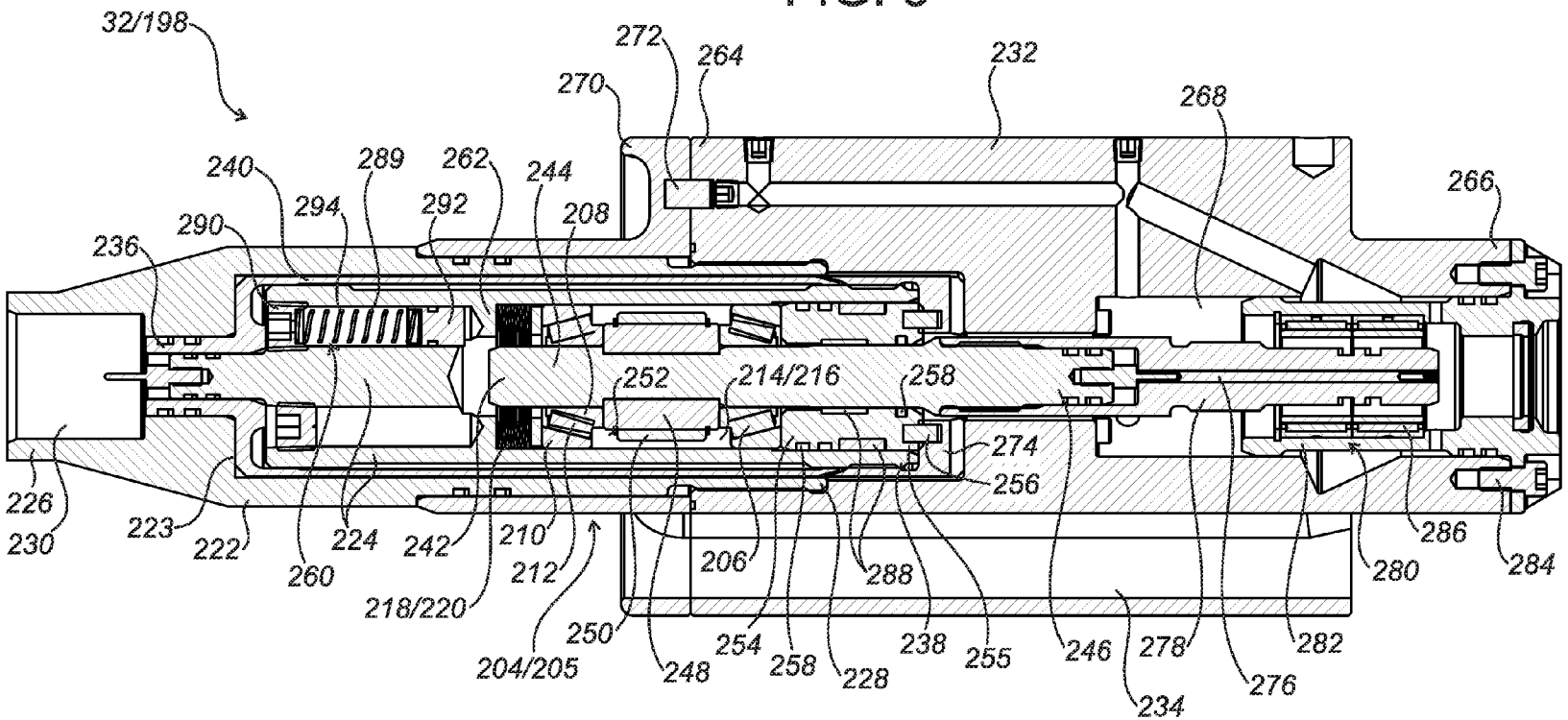
FIG. 3 is a detailed longitudinal sectional view of a first further preferred embodiment of a rotary movement assimilating connector comprising the assimilating connector shown in FIG. 2.
Figure 4:
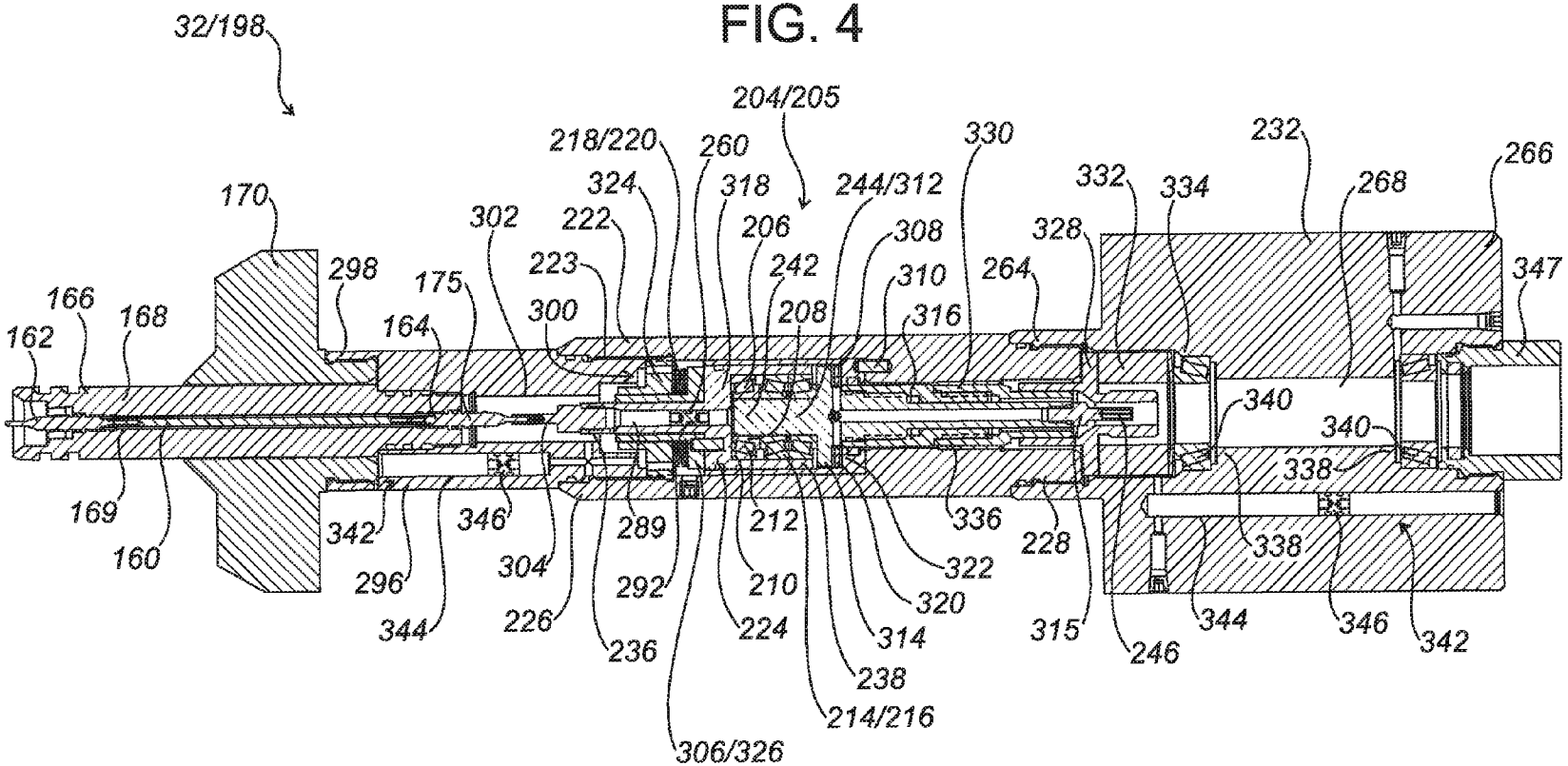
FIG. 4 is a detailed longitudinal sectional view of a second further preferred embodiment of a rotary movement assimilating connector comprising the assimilating connector shown in FIG. 2.

FIG. 2*a* depicts a preferred embodiment of the rotary movement assimilating connector (198) of the present invention. FIG. 3 depicts a first further preferred embodiment of the rotary movement assimilating connector (198), while FIG. 4 depicts a second further preferred embodiment of the rotary movement assimilating connector (198). In each embodiment, the rotary movement assimilating connector (198) is comprised of a bearing assembly (204) for conductively or electrically connecting the housing conductor (38) with the shaft conductor (40).

Thus, the bearing assembly (204) comprises a part or portion of the electrical conducting path (26) of the drilling motor (20). More particularly, the bearing assembly (204) is comprised of a bearing electrical path (205) through the bearing assembly (204) for electrically connecting the housing conductor (38) and the shaft conductor (40). In other words, the conducting path (26) is comprised of the bearing electrical path (205) through the bearing assembly (204).

Preferably, the bearing assembly (204) is comprised of at least one roller bearing (206), and preferably a plurality of roller bearings (206). In the preferred embodiment, each roller bearing (206) is comprised of a tapered roller bearing. Tapered roller bearings typically provide relatively larger contact or bearing surfaces, as compared with other types of roller bearing, which may enhance or facilitate the bearing electrical path (205). Further, the tapered nature of the tapered roller bearing also assists with the prevention of or minimizes any unwanted axial or radial movement of the components of the bearing assembly (204) relative to each other, which facilitates the bearing electrical path (205) by maintaining the electrical contact between the components.

Each tapered roller bearing (206) includes a sloped inner race (208), a compatible sloped outer race (210) and a roller (212) positioned therebetween for contacting the adjacent surfaces of each of the inner and outer races (208, 210). In addition, preferably, the outer race (210) moves with the housing (22) and is electrically connected with the housing conductor (38), while the inner race (208) moves with the shaft (24) and is electrically connected with the shaft conductor (40). Thus, the inner race (208) rotates relative to the outer race (210).

In the preferred embodiment, the conducting path (26), and particularly the bearing electrical path (205), extends through the tapered roller bearing (206) by extending between the inner and outer races (208, 210) across the roller (212) therebetween. Thus, the electrical connection occurs between an inner bearing surface of the outer race (210) and an adjacent outer bearing surface of the roller (212) and between an opposed inner bearing surface of the roller (212) and an adjacent outer bearing surface of the inner race (208).

The rotation of the shaft (24) and the affixed inner race (208) of the roller bearing (206) relative to the housing (22) and the affixed outer race (210) of the roller bearing (206) may induce an undesirable electrical current, resulting in electrical interference and/or noise in the bearing electrical path (205). In order to reduce or minimize any such undesirable induced electrical current, the bearing assembly (204) may be constructed essentially of non-magnetic materials.

Further, in order to enhance or facilitate the electrical connection between the housing and shaft conductors (38, 40), or enhance or facilitate the bearing electrical path (205), the surface area or electrical contact area between the adjacent surfaces may be increased by utilizing a plurality of the tapered roller bearings (206).

In addition, in order to further facilitate or enhance the electrical connection, one or more of the tapered roller bearings (206) may be comprised of a hollow tapered roller bearing. More particularly, the roller (212) of the roller bearing (206) is hollow in order to permit an amount of elastic deformation of the bearing (206) and thus to provide a greater electrical contact area between the components of the bearing assembly (204). For instance, if a preloading force, as discussed below, is provided on the bearing assembly (204), the roller (212) of the roller bearing (206) tends to elastically deform to form a temporary flat spot on the roller (212) which may increase the area of electrical contact of the bearing (206).

As well, in order to further enhance or facilitate the electrical connection between the housing and shaft conductors (38, 40), or enhance or facilitate the bearing electrical path (205), the bearing assembly (204) may be comprised of an electrically conductive fluid (214). In particular, the bearing assembly (204) defines a bearing chamber (216), wherein the electrically conductive fluid (214) is contained in the bearing chamber (216). Thus, the electrically conductive fluid (214) enhances the transmission of electrical signals across the bearing assembly (204). In other words, the electrically conductive fluid (214) provides an additional or enhanced bearing electrical path (205) across the bearing assembly (204).

The electrically conductive fluid (214) may be comprised of any suitable conductive fluid. However, in the preferred embodiment, the electrically conductive fluid (214) is or is comprised of a lubricant for lubricating the bearing assembly (204). Thus, the electrically conductive fluid (214) both enhances the bearing electrical path (205) and lubricates the components of the roller bearing (206).

When used in conjunction with a hollow tapered roller bearing (206), the electrically conductive fluid (214) preferably communicates with the interior of the hollow roller (212). Accordingly, the electrically conductive fluid (214) enhances the bearing electrical path (205) across the roller bearing (206).

Finally, the bearing assembly (204) is preferably comprised of a preloading mechanism (218) for preloading the bearings (206) of the bearing assembly (204). Preloading the bearings (206) may also facilitate or enhance the electrical connection between the housing electrical conductor (38) and the shaft electrical conductor (40). Specifically, the preloading mechanism (218) may minimize the disruption of the bearing electrical path (205) resulting from any undesirable relative movement of the housing and shaft conductors (38, 40).

The preloading mechanism (218) acts to provide more positive contact between the components of the bearing assembly (204) by urging the adjacent bearing surfaces of the bearings (206) into engagement with each other. More particularly, the preloading mechanism (218) urges the inner bearing surface of the outer race (210) into contact with the adjacent outer bearing surface of the roller (212) and further urges the outer bearing surface of the inner race (208) into contact with the adjacent inner bearing surface of the roller (212). In the preferred embodiment, the preloading mechanism (218) is comprised of one or more springs (220) such as annular disk springs or coil springs. Further, the preloading mechanism (218) may be adjustable such that the preloading force on the bearings (206) may be adjusted to provide a desired preloading force. The adjustability of the preloading force allows for changes in vibration to be accounted for with minimal or no degradation of the bearing electrical path (205).

Referring to the preferred embodiment of the rotary movement assimilating connector (198) shown in FIG. 2*a*, the rotary movement assimilating connector (198) is comprised of a protective housing (222) defining a chamber (223) for containing an insert housing (224) therein. The protective housing (222) extends from a proximal end (226) to a distal end (228) within the upper sub housing (138). The proximal end (226) defines a bore (230) or channel extending from the proximal end (226) to the chamber (223) such that the distal end (164) of the housing conductive member (160 may pass therethrough. Specifically, the housing conductor member (160) of the housing conductor (38) extends through the protective housing (222) for electrical connection with the insert housing (224), as described further below.

Further, in order to maintain the position of the housing conductive member (160), the proximal end (226) of the protective housing (222) is mounted or otherwise associated with the connector housing (168) and the centralizer (170) of the upper housing electrical connector (166). Similarly, the distal end (228) of the protective housing (222) is also fixedly mounted with or maintained in a fixed position within the housing (22) so that the protective housing (222) moves or rotates with the housing (22) relative to the shaft (24). The distal end (228) of the protective housing (222) may be attached, connected or fixed in a desired position within the upper sub housing (138) by any compatible connecting mechanism or assembly. In the preferred embodiment, the protective housing (222) is held in a desired position by a compatible hanger, mounting plate or centralizer (232).

In the preferred embodiment, as shown in FIG. 2*a*, the distal end (228) of the protective housing (222) is threadably engaged with the centralizer (232), which is in turn threadably engaged with the proximal end (134) of the upper flex sub housing (132) such that the centralizer (232) and the protective housing (222) move with the upper flex sub housing (132). Further, the centralizer (232) is positioned within the fluid pathway (142) through the upper flex sub housing (132) and defines one or more channels (234) therethrough to permit the flow of fluid through the fluid pathway (142) relatively unimpeded. Rather than a threaded engagement therebetween, the centralizer (170) may be fixedly or rigidly connected with the upper flex sub housing (132) and the protective housing (222) in any alternate manner either permanently, such as by welding, or removably, such as by one or more screws or alternate fasteners.

The insert housing (224) is contained and fixedly mounted or fastened within the chamber (223) of the protective housing (222) in a manner such that the insert housing (224) moves or rotates with the protective housing (222). The insert housing (224) may be fixedly mounted or fastened, either permanently or removably, within the chamber (223) in any manner compatible with the operation of the rotary movement assimilating connector (198).

Further, the insert housing (224) extends from a proximal end (236) to a distal end (238) and contains the bearing assembly (204) therein. The proximal end (236) of the insert housing (224) is adapted for electrical connection with the lower housing electrical connector (175) comprising the distal end (164) of the housing conductive member (160) such that the housing conductive member (160) is electrically connected with the insert housing (224). In other words, the conducting path (26) extends from the housing conductive member (160) comprising the housing conductor (38) to the insert housing (224) of the rotary movement assimilating connector (198).

If desired or necessary to facilitate the transmission of the electrical signals through the insert housing (224), an electrically insulative material may be provided within the chamber (223) of the protective housing (222) between the insert housing (224) and the protective housing (222). In the preferred embodiment, an electrically insulating sleeve (240) surrounds the insert housing (224) to electrically insulate the insert housing (224) from the adjacent surface of the protective housing (222). Alternately, the conducting path (26) through the rotary movement assimilating connector (198) may be insulated or protected from short-circuiting or electrical interference in any other suitable manner.

The bearing assembly (204) comprising the rotary movement assimilating connector (198) is contained within the insert housing (224). Thus, the bearing assembly (204) defines the bearing chamber (216) within the insert housing (224). Further, a proximal end (242) of a conductive shaft (244) extends within the bearing chamber (216) of the bearing assembly (204), while a distal end (246) of the conductive shaft (244) is adapted for connection with the transverse movement assimilating connector (200). As described further below, the conductive shaft (244) is indirectly connected or associated with the shaft conductive member (176) comprising the shaft conductor (40) such that the conductive shaft (244) moves or rotates with the shaft (24) relative to the housing (22).

Accordingly, the conductive shaft (244) rotates relative to the insert housing (224). Further, the conductive shaft (244) is rotatably supported within the insert housing (224) by the bearing assembly (204), as described above. In the preferred embodiment shown in FIG. 2*a*, the insert housing (224), the bearing assembly (204) and the conductive shaft (244) substantially comprise the conducting path (26) or electrical bearing path (205) through the rotary movement assimilating connector (198).

The bearing assembly (204) is comprised of a plurality of tapered roller bearings (206). The sloped inner race (208) of each tapered roller bearing (206) is mounted or affixed with the conductive shaft (244) such that the inner race (208) rotates with and is electrically connected to the conductive shaft (244). The sloped outer race (210) of each tapered roller bearing (206) is mounted or affixed with the surface of the insert housing (224) within the bearing chamber (216) such that the outer race (210) rotates with and is electrically connected to the insert housing (224). The roller (212) is positioned therebetween for contacting the adjacent surfaces of each of the inner and outer races (208, 210).

Preferably, the bearing assembly (204) is comprised of the electrically conductive fluid (214). In particular, the electrically conductive fluid (214) is contained within the bearing chamber (216) of the bearing assembly (204) such that the tapered roller bearings (206) are substantially contained within the electrically conductive fluid (214). Thus, the electrically conductive fluid (214) may both enhance the transmission of electrical signals through the bearing electrical path (205) and lubricate the tapered roller bearings (206).

The roller bearings (206) may be held in a desired longitudinal position along the conductive shaft (244) by any fastening or connecting mechanism capable of retaining the position of the bearings (206) while permitting them to perform their intended function. Preferably, the roller bearings (206) are held in position along the conductive shaft (244), at least in part, by an assembly of a split shell (248) and a locking shell (250) held in position with one or more retaining rings (252). The placement of the split shell (248) between the roller bearings (206) further facilitates the application of a preloading force to the roller bearings (206) by the preloading mechanism (218), as discussed below.

Further, a seal assembly (254) is preferably sealingly mounted within the bearing chamber (216) adjacent the distal end (238) of the insert housing (224). The seal assembly (254) is comprised of a seal assembly housing (255) which may be permanently or removably mounted or affixed within the insert housing (224) by any compatible connecting or fastening mechanism. In the preferred embodiment, the seal assembly housing (255) is mounted within the insert housing (224) by one or more fasteners (256), such as a screw, bolt or dowel pin. In this embodiment, as shown in FIG. 2*a*, the seal assembly housing (255) is threadably engaged with the adjacent surface of the insert housing (224). Further, a fastener (256) comprised of one or more screws extends between the seal assembly housing (255) and the adjacent centralizer (232).

The seal assembly (254) includes one or more seals (258), such as O-rings or sealing structures, such that the distal end (238) of the insert housing (224) is sealed. Preferably, the seals (258) are located both about the outer surface of the seal assembly housing (255) to seal between the seal assembly housing (255) and the adjacent insert housing (224) and about the inner surface of the seal assembly housing (255) to seal between the seal assembly housing (255) and the adjacent conductive shaft (244).

Accordingly, the bearing chamber (216) is sealed such that the electrically conductive fluid (214) may be retained therein. The electrically conductive fluid (214) in the bearing chamber (216) may be pressure balanced with the fluid in the fluid pathway (142). Thus, a pressure balance or compensator assembly (260) may be associated with the bearing chamber (216). Any compatible pressure balance or compensator assembly (260) may be used which is capable of balancing the fluid pressures within the bearing chamber (216) and the fluid pathway (142).

Finally, in this embodiment, the preloading mechanism (218) is provided for applying a preloading force to the tapered roller bearings (206) within the bearing chamber (216). As shown in FIG. 2*a*, the insert housing (224) is comprised of a bearing shoulder (262) which defines one end of the bearing chamber (216). The opposite end of the bearing chamber (216) is defined by the seal assembly (254). Thus, the bearings (206) and the preloading mechanism (218) are contained within the bearing chamber (216) between the bearing shoulder (262) and the seal assembly (254). More particularly, the preloading mechanism (218) is positioned between the bearing shoulder (262) and a first tapered roller bearing (206). The first tapered roller bearing (206) is positioned between the preloading mechanism (218) and the split shell (248). The second tapered roller bearing (206) is positioned between the split shell (248) and the seal assembly housing (255).

The preloading mechanism (218) is adapted such that the preloading mechanism (218) applies a radial load through the roller bearings (206) and urges the tapered bearing surfaces of each of the tapered roller bearings (206) into closer proximity in order to enhance the electrical contact therebetween. In this embodiment, the preloading mechanism (218) is comprised of one or more springs (220), preferably a plurality of belleville springs, which act between the bearing shoulder (262) and the adjacent first roller bearing (206). The preloading force on the bearings (206) may be adjusted in this embodiment by pre-selecting the desired number and type of springs (220) to be used or adjusting the position of the seal assembly housing (255) at the end of the bearing chamber (216).

FIG. 3 depicts a first further preferred embodiment of the rotary movement assimilating connector (198). Referring to this first further embodiment of the rotary movement assimilating connector (198), many of the components are the same as those described for the embodiment shown in FIG. 2*a* and the same reference numbers have been used where applicable.

Referring to FIG. 3, the rotary movement assimilating connector (198) is also comprised of the protective housing (222) defining the chamber (223) for containing the insert housing (224) therein. The proximal end (226) of the protective housing (222) similarly defines the bore (230) or channel which extends from the proximal end (226) to the chamber (223) such that the distal end (164) of the housing conductive member (160) may pass therethrough. The connector housing (168) through which the housing conductive member (160) extends is shaped or otherwise configured to be compatible for connection with the proximal end (226) of the protective housing (222). The housing conductive member (160) of the housing conductor (38) extends through the bore (230) of the protective housing (222) for electrical connection with the proximal end (236) of the insert housing (224).

The protective housing (222) may be maintained in position and connected with the upper sub housing (138) in any suitable manner and at any location along the length of the protective housing (222) between its proximal and distal ends (226, 228). In this embodiment, the distal end (228) of the protective housing (222) is preferably fixedly mounted with or maintained in a fixed position within the housing (22) so that the protective housing (222) moves or rotates with the housing (22) relative to the shaft (24). Although the distal end (228) of the protective housing (222) may be attached, connected or fixed in a desired position within the upper sub housing (138) by any compatible connecting mechanism or assembly, the protective housing (222) is preferably held in a desired position by a compatible hanger, mounting plate or centralizer (232).

As shown in FIG. 3, the distal end (228) of the protective housing (222) is threadably engaged with the centralizer (232), which is in turn mounted within either the upper sub housing (138) or the upper flex sub housing (132). Accordingly, the centralizer (232) and the protective housing (222) move and rotate with the upper flex sub housing (132). As described above, the centralizer (232) is positioned within the fluid pathway (142) through the upper flex sub housing (132) and defines one or more channels (234) therethrough to permit the flow of fluid through the fluid pathway (142) relatively unimpeded.

The centralizer or mounting plate (232) shown in FIG. 3 has a proximal end (264), a distal end (266) and a bore (268) extending between the proximal and distal ends (264, 266) for accommodating or receiving other components of the rotary movement assimilating connector (198) therein and for providing the conducting path (26) therethrough, as described further below. For instance, the distal end (228) of the protective housing (222) is received within and engaged with the bore (268) of the centralizer (232) adjacent the proximal end (264) thereof. Further, the distal end (238) of the insert housing (224) extends from the distal end (228) of the protective housing (222) within the bore (268) towards the distal end (266) of the centralizer (232).

If desired, an erosion shield (270) may be mounted with the proximal end (264) of the centralizer (232) to reduce the wear on the centralizer (232) as fluid flows from the fluid pathway (142) into the channels (234) defined by the centralizer (232). The erosion shield (270) may be mounted, either permanently or removably, by any compatible fastening mechanism or fastener. Preferably, the erosion shield (270) is mounted with one or more dowel pins (272) extending between the erosion shield (270) and the centralizer (232).

The insert housing (224) is fixedly mounted or fastened within the chamber (223) of the protective housing (222) in a manner such that the insert housing (224) moves or rotates with the protective housing (222). The proximal end (236) of the insert housing (224) is adapted for electrical connection with the lower housing electrical connector (175), such as by a compatible electrical fitting, so that the housing conductive member (160) is electrically connected with the insert housing (224). As a result, the conducting path (26) extends from the housing conductive member (160) comprising the housing conductor (38) to the insert housing (224) of the rotary movement assimilating connector (198).

An electrically insulative material is provided to insulate the insert housing (224) from the surrounding structure. Specifically, referring to FIG. 3, an electrically insulating sleeve or shell (240) surrounds the insert housing (224) between the insert housing (224) and the protective housing (222). Further, an electrical insulator (274), preferably a torque holding insulator, surrounds the distal end (238) of the insert housing (224) between the insert housing (224) and the adjacent centralizer (232). Thus, the insulating sleeve (240) and torque holding insulator (274) electrically insulate the insert housing (224) from the adjacent surfaces of the protective housing (222) and the centralizer (232) to facilitate the conducting path (26) extending therethrough.

As in the embodiment of FIG. 2*a*, the bearing assembly (204) of FIG. 3 is also contained within the insert housing (224). Similarly, the proximal end (242) of a conductive shaft (244) extends within the bearing chamber (216) of the bearing assembly (204), while a distal end (246) of the conductive shaft (244) is adapted for connection with the transverse movement assimilating connector (200). In the embodiment of FIG. 3, the distal end (246) of the conductive shaft (244) extends from the distal end (238) of the insert housing (224) within the bore (268) of the centralizer (232). Further, the distal end (246) of the conductive shaft (244) is electrically connected with a conductive shaft extension member (276) which extends from the distal end (246) of the conductive shaft (244) through the bore (268) of the centralizer (232) for electrical connection with the transverse movement assimilating connector (200).

An electrically insulative material is provided to insulate the conductive shaft extension member (276). Specifically, referring to FIG. 3, an insulator shaft (278) is threadably engaged with the distal end (246) of the conductive shaft (244) and substantially surrounds the distal end (246) of the conductor shaft (244) and the conductive shaft extension member (276) to insulate them from the adjacent centralizer (232) and associated structures. The conductive shaft (244), the conductive shaft extension member (276) and the insulator shaft (278) are indirectly connected or associated with the shaft conductive member (176) comprising the shaft conductor (40) such that each of the conductive shaft (244), the conductive shaft extension member (276) and the insulator shaft (278) moves or rotates with the shaft (24) relative to the housing (22).

In the embodiment shown in FIG. 3, the insert housing (224), the bearing assembly (204), the conductive shaft (244) and the conductive shaft extension member (276) substantially comprise the conducting path (26) through the rotary movement assimilating connector (198).

As described previously, the conductive shaft (244) is rotatably supported within the insert housing (224) by the bearing assembly (204). Further, referring to FIG. 3, the insulator shaft (278) is also preferably rotatably supported within the bore (268) of the centralizer (232). In particular, an insulator shaft bearing assembly (280) is provided for the insulator shaft (278). The insulator shaft bearing assembly (280) is comprised of a bearing housing (282) mounted with the centralizer (232) such that the bearing housing (282) is substantially contained within the bore (268) of the centralizer (232) adjacent the distal end (226) thereof. The bearing housing (282) may be permanently or removably mounted with the centralizer (232) in any manner and by any connecting or fastening mechanism compatible with the intended function of the bearing assembly (280). Preferably, the bearing housing (282) is fixedly mounted with the distal end (266) of the centralizer (232) by one or more fasteners (284), such as screws or bolts as shown in FIG. 3.

The bearing housing (282) is further positioned within the bore (268) of the centralizer (232) such that the insulator shaft (278) extends therein. The insulator shaft bearing assembly (280) is further comprised of at least one, and preferably a plurality of bearings (286), for rotatably supporting the insulator shaft (278) within the bearing housing (282). The bearings (286) may be comprised of any suitable type or configuration of bearings. However, preferably, each of the bearings (286) is comprised of a needle roller bearing.

The bearing assembly (204) of the embodiment of FIG. 3 is substantially similar to the bearing assembly (204) of FIG. 2*a* described above and is comprised of a plurality of the tapered roller bearings (206). The inner race (208) of each roller bearing (206) is mounted or affixed with the conductive shaft (244) such that the inner race (208) rotates with and is electrically connected to the conductive shaft (244), while the outer race (210) of each roller bearing (206) is mounted or affixed with the surface of the insert housing (224) such that the outer race (210) rotates with and is electrically connected to the insert housing (224). The roller (212) is positioned therebetween for contacting the adjacent surfaces of each of the inner and outer races (208, 210). Further, the electrically conductive fluid (214) is preferably contained within the bearing chamber (216) of the bearing assembly (204) such that the tapered roller bearings (206) are substantially contained within the electrically conductive fluid (214).

In this embodiment, the roller bearings (206) are held in position along the conductive shaft (244), at least in part, by the assembly comprised of the split shell (248) and the locking shell (250), as described previously, held in position with one or more retaining rings (252). Further, the seal assembly (254) is sealingly mounted within the bearing chamber (216) adjacent the distal end (238) of the insert housing (224). In this embodiment, the seal assembly housing (255) is mounted within the insert housing (224) by one or more fasteners (256), preferably one or more dowel pins extending between the seal assembly housing (255) and the adjacent torque holding insulator (274), which is threadably engaged with the insert housing (224).

The seal assembly (254) includes one or more seals (258), such as O-rings or sealing structures, such that the distal end (238) of the insert housing (224) is sealed. Preferably, the seals (258) are located both about the outer surface of the seal assembly housing (255) to seal between the seal assembly housing (255) and the adjacent insert housing (224) and about the inner surface of the seal assembly housing (255) to seal between the seal assembly housing (255) and the adjacent conductive shaft (244). Similarly, the seal assembly (254) may include one or more wear rings (288), preferably located both about the outer surface of the seal assembly housing (255) and about the inner surface of the seal assembly housing (255).

The electrically conductive fluid (214) in the bearing chamber (216) may be pressure balanced with the fluid in the fluid pathway (142). Thus, as shown in FIG. 3, a pressure balance or compensator assembly (260) may be associated with the bearing chamber (216). Any compatible pressure balance or compensator assembly (260) may be used which is capable of balancing the fluid pressures within the bearing chamber (216) and the fluid pathway (142). In this embodiment, the compensator assembly (260) is located adjacent the proximal end (236) of the insert housing (224) and is comprised of a compensator chamber (289) defined within the proximal end (236) of the insert housing (224). Further, a compensator plug (290) is provided to seal one end of the compensator chamber (289), while a movable compensator piston (292) is provided at the opposed end of the compensator chamber (289). A compensator spring (294) is provided between the compensator plug (290) and the compensator piston (292) to urge the piston (292) away from the plug (290). The pressure of the conductive fluid (214) in the bearing chamber (216) acts upon the surface of the compensator piston (292) opposed to the spring (294) to urge the piston (292) towards the compensator plug (290). Similarly, if desired, a pressure balance or compensator assembly may be associated with the insulator shaft bearing assembly (280).

Finally, in the embodiment of FIG. 3, the preloading mechanism (218) described previously is provided for the roller bearings (206). Thus, the bearings (206) and the preloading mechanism (218) are contained within the bearing chamber (216) between the bearing shoulder (262) and the seal assembly (254). More particularly, the preloading mechanism (218) is positioned between the bearing shoulder (262) and a first tapered roller bearing (206). The first tapered roller bearing (206) is positioned between the preloading mechanism (218) and the split shell (248). The second tapered roller bearing (206) is positioned between the split shell (248) and the seal assembly housing (255). As above, the preloading mechanism (218) is comprised of one or more springs (220), preferably a plurality of belleville springs, which act between the bearing shoulder (262) and the adjacent first roller bearing (206).

FIG. 4 depicts a second further preferred embodiment of the rotary movement assimilating connector (198). Referring to this second further embodiment of the rotary movement assimilating connector (198), many of the components are the same as those previously described for the embodiments shown in FIGS. 2*a* and 3 and the same reference numbers have been used where applicable.

Referring to FIG. 4, the rotary movement assimilating connector (198) is comprised of the protective housing (222) defining the chamber (223) for containing the insert housing (224) therein. The chamber (223) extends from within the protective housing (222) to the proximal end (226) thereof. The rotary movement assimilating connector (198) is further comprised of a top cap (296) having a proximal end (298) and a distal end (300) and defining a bore (302) therethrough. The proximal end (226) of the protective housing (222) is threadably engaged with the distal end (300) of the top cap (296) such that the chamber (223) is continuous with the bore (302) and such that the distal end (164) of the housing conductive member (160) may pass within the bore (302) for electrical connection with the insert housing (224).

The connector housing (168), through which the housing conductive member (160) extends, is shaped or otherwise configured to be compatible for connection with the proximal end (298) of the top cap (296). Thus, the housing conductive member (160) of the housing conductor (38) extends through the bore (302) of the top cap (296) for electrical connection with the proximal end (236) of the insert housing (224). Preferably, the proximal end (236) of the insert housing (224) is comprised of an electrical fitting or bulkhead connector (304) for providing the conducting path (26) therethrough.

In addition, as discussed previously, the connector housing (168) is preferably held in a desired position within the upper sub housing (138) by a compatible hanger or centralizer (170). In this embodiment, the centralizer (170) is threadably engaged with the proximal end (298) of the top cap (296) and surrounds a portion of the connector housing (168) in order to maintain the housing conductive member (160) in a desired position.

Further, in the embodiment of FIG. 4, the distal end (228) of the protective housing (222) is preferably fixedly mounted with or maintained in a fixed position within the housing (22) so that the protective housing (222) moves or rotates with the housing (22) relative to the shaft (24). More particularly, the distal end (228) of the protective housing (222) is preferably held in a desired position by a compatible hanger, mounting plate or centralizer (232).

As shown in FIG. 4, the distal end (228) of the protective housing (222) is threadably engaged with the centralizer (232), which is in turn mounted within either the upper sub housing (138) or the upper flex sub housing (132). Accordingly, the centralizer (232) and the protective housing (222) move and rotate with the housing (22). As described above, the centralizer (232) is positioned within the fluid pathway (142) through the housing (22) and defines one or more channels (not shown in FIG. 4) therethrough to permit the flow of fluid through the fluid pathway (142) relatively unimpeded.

The centralizer or mounting plate (232) shown in FIG. 4 has a proximal end (264), a distal end (266) and a bore (268) extending between the proximal and distal ends (264, 266) for accommodating or receiving other components of the rotary movement assimilating connector (198) therein and for providing the conducting path (26) therethrough, as described further below. For instance, the distal end (228) of the protective housing (222) is received within and engaged with the bore (268) of the centralizer (232) adjacent the proximal end (264) thereof.

The insert housing (224) is directly or indirectly mounted or fastened within the chamber (223) of the protective housing (222) in a fixed manner such that the insert housing (224) moves or rotates with the protective housing (222). As indicated, the proximal end (236) of the insert housing (224) is comprised of a bulkhead connector (304) adapted for electrical connection with the lower housing electrical connector (175) so that the housing conductive member (160) is electrically connected with the insert housing (224). As a result, the conducting path (26) once again extends from the housing conductive member (160) comprising the housing conductor (38) to the insert housing (224) of the rotary movement assimilating connector (198).

An electrically insulative material is provided to insulate the insert housing (224) from the surrounding structure. Specifically, referring to FIG. 4, an electrically insulating sleeve or shell substantially surrounds the outermost surface of the insert housing (224) between the insert housing (224) and the protective housing (222). More particularly, a proximal insulating sleeve (306) is provided adjacent the proximal end (236) of the insert housing (224), while a distal insulating sleeve (308) is provided adjacent the distal end (238) of the insert housing (224). The proximal insulating sleeve (306) is preferably mounted with the insert housing (224). The distal insulating sleeve (308) is preferably mounted with the protective housing (222) by one or more fasteners, preferably one or more dowel pins (310).

As in the previous embodiments of FIGS. 2*a* and 3, the bearing assembly (204) of FIG. 4 is also contained within the insert housing (224). Similarly, the proximal end (242) of a conductive shaft (244) extends within the bearing chamber (216) of the bearing assembly (204), while a distal end (246) of the conductive shaft (244) is adapted for connection with the transverse movement assimilating connector (200). However, in the embodiment of FIG. 4, the conductive shaft (244) is comprised of a rotating bearing spindle (312) defining a bearing flange (314) along the length thereof which is positioned outside of the insert housing (224) adjacent the distal end (238) thereof. Thus, the proximal end (242) of the conductive shaft (244) extends from the bearing flange (314) within the insert housing (224) for engagement with the bearing assembly (204). The distal end (246) of the conductive shaft (244) extends from the bearing flange (314) away from the insert housing (224) within the protective housing (222). Preferably, the distal end (246) of the conductive shaft (244) is comprised of an electrical fitting or bulkhead connector (315) for providing the conducting path (26) therethrough and for connecting with the transverse movement assimilating connector (200).

The bearing flange (314) is electrically insulated by the placement of the distal insulating sleeve (308) within the protective housing (222). Preferably, at least one thrust bearing (320) is provided between the bearing flange (314) and an adjacent shoulder (322) defined by the distal insulating sleeve (308). Further, an electrically insulative material is also preferably provided to insulate the distal end (246) of the conductive shaft (244) as it passes through the protective housing (222). Specifically, referring to FIG. 4, an insulating adaptor (316) is threadably engaged with or otherwise affixed about the distal end (246) such that the insulating adaptor (316) moves and rotates with the conductive shaft (244). The conductive shaft (244) and the insulating adaptor (316) are indirectly connected or associated with the shaft conductive member (176) comprising the shaft conductor (40), in a manner described further below, such that each of the conductive shaft (244) and the insulating adaptor (316) moves or rotates with the shaft (24) relative to the housing (22).

In the embodiment shown in FIG. 4, the insert housing (224), the bearing assembly (204) and the conductive shaft (244) substantially comprise the conducting path (26) through the rotary movement assimilating connector (198).

As described previously, the proximal end (242) of the conductive shaft (244) is rotatably supported within the insert housing (224) by the bearing assembly (204). The bearing assembly (204) of the embodiment of FIG. 4 is similar to the bearing assembly (204) of FIGS. 2*a* and 3 described above. The bearing assembly (204) is comprised of a plurality of the tapered roller bearings (206), wherein the inner race (208) of each roller bearing (206) is mounted or affixed with the conductive shaft (244) such that the inner race (208) rotates with and is electrically connected to the conductive shaft (244). The outer race (210) of each roller bearing (206) is mounted or affixed with the adjacent surface of the insert housing (224) such that the outer race (210) rotates with and is electrically connected to the insert housing (224). The roller (212) is positioned therebetween for contacting the adjacent surfaces of each of the inner and outer races (208, 210). Further, the electrically conductive fluid (214) is preferably contained within the bearing chamber (216) of the bearing assembly (204) such that the tapered roller bearings (206) are substantially contained within the electrically conductive fluid (214).

This embodiment does not include the assembly comprised of the split shell (248) and the locking shell (250), as described previously for FIGS. 2*a* and 3, nor does it include the seal assembly (254). Rather, the roller bearings (206) are simply held in position within the bearing chamber (216) between a bearing contact shoulder (318) provided by the insert housing (224) and the bearing flange (314) of the rotating bearing spindle (312).

The electrically conductive fluid (214) in the bearing chamber (216) may be pressure balanced with the fluid in the fluid pathway (142). Thus, as shown in FIG. 4, a pressure balance or compensator assembly (260) is associated with the bearing chamber (216). Any compatible pressure balance or compensator assembly (260) may be used which is capable of balancing the fluid pressures within the bearing chamber (216) and the fluid pathway (142). In the embodiment of FIG. 4, the compensator assembly (260) is located within the proximal end (236) of the insert housing (224) and is comprised of a compensator chamber (289) defined within the proximal end (236) of the insert housing (224). Further, a movable compensator piston (292) is provided within the compensator chamber (289). The pressure of the fluid within the fluid pathway (142) is communicated to and acts upon a first side of the compensator piston (292) to urge the compensator piston (292) towards the rotating bearing spindle (312), while the pressure of the conductive fluid (214) in the bearing chamber (216) is communicated to and acts upon an opposed second side of the compensator piston (292) to urge the compensator piston (292) away from the rotating bearing spindle (312).

In addition, in the embodiment of FIG. 4, a preloading mechanism (218) is provided for the roller bearings (206). The preloading mechanism (218) in the embodiment of FIG. 4 is comprised of a first preload nut (324) fixedly mounted within the chamber (223) of the protective housing (222), such as by a threaded engagement, such that the first preload nut (324) surrounds the proximal insulating sleeve (306) at the proximal end (236) of the insert housing (224). Further, the preloading mechanism (218) is comprised of one or more springs (220), preferably a plurality of belleville springs, which act between the first preload nut (324) and a shoulder (326) defined by the proximal insulating sleeve (306) to urge the insert housing (224) towards the bearing flange (314).

Further, the preloading mechanism (218) is preferably comprised of second preload nut (328) which is slidably mounted about the distal end (246) of the conductive shaft (244) by an interconnecting spline connector (330). The spline connector (330) provides a splined connection between the insulating adaptor (316), fixedly mounted with the conductive shaft (244), and the second preload nut (328). Thus, the second preload nut (328) is longitudinally slidable or movable relative to the conductive shaft (244). However, the second preload nut (328) is rotatably fixed with the conductive shaft (244) by the splined connection therebetween such that rotation of the second preload nut (328) causes rotation of the conductive shaft (244). The second preload nut (328) is adapted for connection with the transverse movement assimilating connector (202). As well, a preload bushing (332) is urged into close engagement with the second preload nut (328) by one or more further springs (220), preferably a plurality of belleville springs, which act between the preload bushing (332) and an adjacent shoulder (334) defined by the bore (268) of the centralizer (232). Thus, the second preload nut (328) is urged towards the bearing assembly (204). Finally, if desired, one or more bushings (336) may be associated with the spline connector (330) between the spline connector (330) and the adjacent protective housing (222).

Further, referring to FIG. 4, as stated, the distal end (2460 of the conductive shaft (244) is adapted for connection with the transverse movement assimilating connector (202). In particular, as described further below, the transverse movement assimilating connector (202) extends within the bore (268) of the centralizer (232) for connection with the conductive shaft (244). If desired, a centralizer bearing assembly (338) may be associated with the bore (268) of the centralizer (232) for rotatably supported the structure or components of the transverse movement assimilating connector (202) therein. Any suitable bearing assembly may be used. For instance, as shown in FIG. 4, the centralizer bearing assembly (338) may be comprised of one or more bearings (340). The bearings (340) may be comprised of any suitable type or configuration of bearings. However, preferably, each of the bearings (340) is comprised of a tapered roller bearing. Further, the centralizer bearing assembly (338) may be sealed, if desired, by any suitable sealing assembly or structure, such as a seal nut (347) at the distal end (266) of the centralizer (232).

In addition, if desired, one or more supplemental compensator or pressure balance assemblies (342) may be associated with the rotary movement assimilating connector (198). For instance, a supplemental compensator or pressure balance assembly (342) may be located within the top cap (296). In addition, a further supplemental compensator or pressure balance assembly (342) may be located within the centralizer (232). In each case, the supplemental compensator or pressure balance assembly (342) is preferably comprised of a compensator chamber (344) defined within the top cap (296) and the centralizer (232) respectively. Further, a movable compensator piston (346) is provided within the compensator chamber (344). The pressure of the fluid within the fluid pathway (142) is communicated to and acts upon a first side of the compensator piston (346) to urge the compensator piston (346) in a first direction, while the pressure of the fluid within the rotary movement assimilating connector (232) is communicated to and acts upon an opposed second side of the compensator piston (346) to urge the compensator piston (346) in a second direction opposed to the first direction.

Referring to FIGS. 2*a*-2*c* and 5, the assimilating connector (32) is further comprised of the transverse movement assimilating connector (202) for assimilating a transverse movement of the shaft conductor (40) relative to the housing conductor (38). Specifically, the transverse movement assimilating connector (202) is provided to absorb the eccentric and axial movements of the shaft conductor (40) relative to the housing conductor (38) so that the conducting path (26) through the drilling motor (20) may be maintained.

FIGS. 2*a*-2*c* and FIG. 5 show alternate configurations of the preferred embodiment of the transverse movement assimilating connector (202) which are comprised of substantially the same components functioning in substantially the same manner. Thus, the same reference numbers are used throughout the Figures.

In the preferred embodiment, the transverse movement assimilating connector (202) is comprised of an electrically conductive extension member (348) for electrically connecting, at least in part, the housing conductor (38) and the shaft conductor (40) with each other. The extension member (348) extends from a proximal end (350) to a distal end (352) and may be comprised of any electrically conductive wire, cable or shaft. However, in the preferred embodiment, the extension member (348) is comprised of an electrically conductive flexible shaft (354). Thus, the extension member (248), comprised of the flexible shaft (354), comprises a part or portion of the conducting path (26) within the housing (22) of the drilling motor (20).

Figure 5:
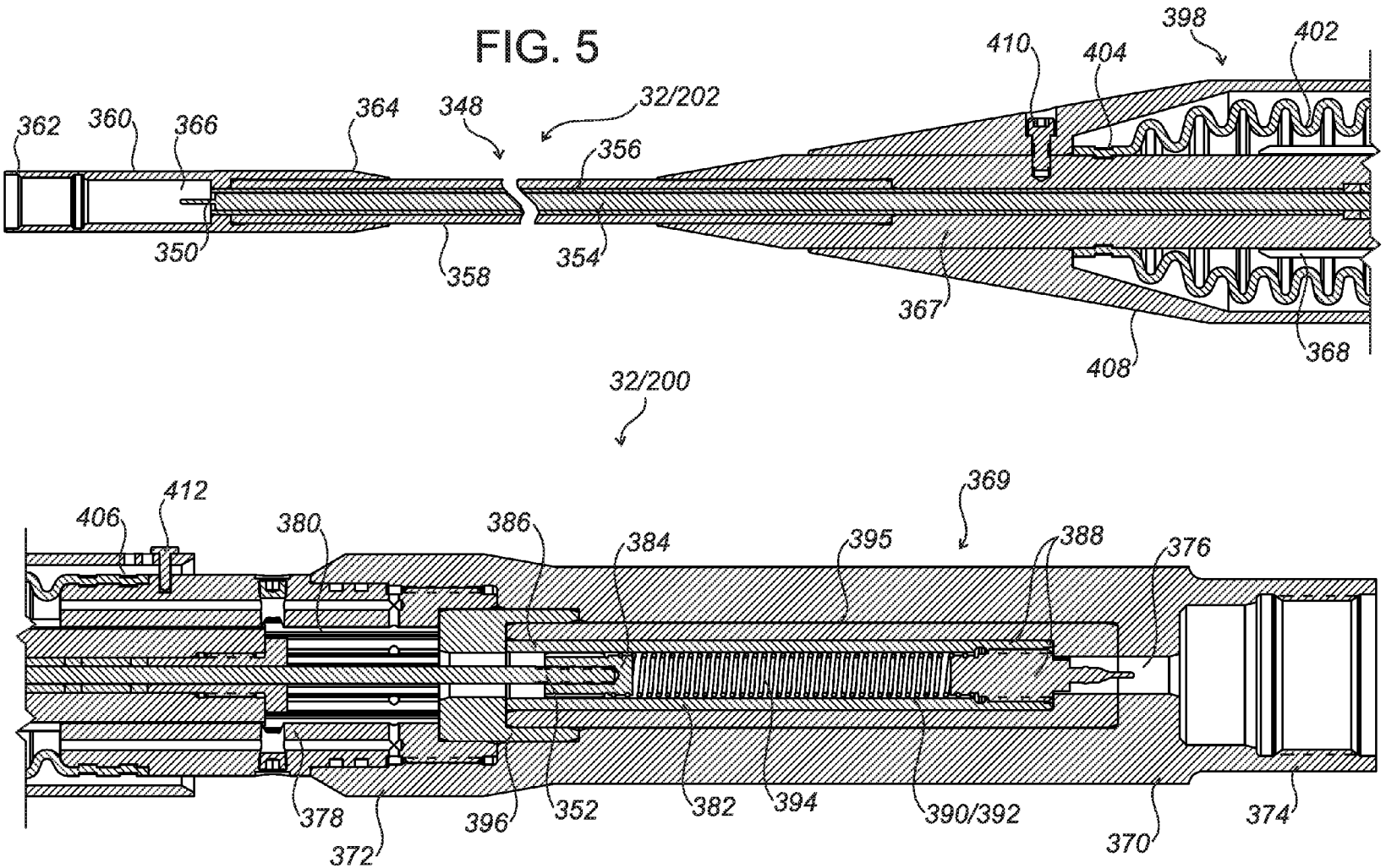
FIG. 5 is a detailed longitudinal sectional view of a further preferred embodiment of a longitudinal movement assimilating connector and a transverse movement assimilating connector comprising the assimilating connector shown in FIG. 2.

Further, if desired or required to facilitate the transmission of electrical signals therethrough along the conducting path (26), an electrically insulative material may be associated with the flexible shaft (354) along the entire length of the flexible shaft (354) or a part or portion thereof. Referring to FIG. 5, the extension member (348) is further comprised of an insulative sleeve (356) surrounding the flexible shaft (354) and provided along at least a portion of the length of the flexible shaft (254).

As well, if desired, a further flexible covering or sleeve (358) may be provided about the insulative sleeve (356) along the entire length of the flexible shaft (354) or a part or portion thereof. The flexible sleeve (358) is provided to protect the insulative sleeve (356) and/or to provide support to the flexible shaft (354). The flexible sleeve (358) may be comprised of any suitable flexible material compatible with the functioning of the flexible shaft (354) and the insulative sleeve (356).

The proximal end (350) of the extension member (348), comprised of the flexible shaft (354), is adapted for electrical connection with the distal end (246) of the conductive shaft (244) of the rotary movement assimilating connector (198). The distal end (352) of the extension member (348), comprised of the flexible shaft (354), is adapted for electrical connection with the longitudinal movement assimilating connector (200).

The electrical connection at the proximal end (350) of the extension member (348) may be either direct, as shown in FIGS. 2*a* and 4, or indirect via the conductive shaft extension member (276), as shown in FIG. 3. In addition to providing an electrical connection, the connection is also adapted such that the extension member (348) and the conductive shaft (244) rotate together. In order to facilitate the connection, the proximal end (350) of the extension member (348) is preferably comprised of or associated with a proximal adaptor (360). As shown in FIGS. 2*a* and 5, the proximal adaptor (360) has a proximal end (362), a distal end (364) and a bore (366) extending therethrough. The proximal end (350) of the extension member (348) extends within the distal end (364) of the proximal adaptor (360) and is fixedly mounted within the bore (366). The proximal end (362) of the proximal adaptor (360) is configured and adapted for fixedly mounting to or fastening with the conductive shaft (244), either directly or indirectly.

Thus, as shown in FIG. 2*a*, the distal end (246) of the conductive shaft (244) is received within and fixedly mounted with the bore (366) of the proximal adaptor (360) adjacent the proximal end (362). As shown in FIG. 4, the proximal adaptor (360) is extended through the bore (268) of the centralizer (232) and the distal end (246) of the conductive shaft (244) and the second preload nut (328) are received within and fixedly mounted with the bore (366) of the proximal adaptor (360) adjacent the proximal end (362). Finally, as shown in FIG. 3, the proximal adaptor (360) is extended within the bearing housing (282) of the insulating shaft bearing assembly (280) and the end of the insulating shaft (278) is received within and fixedly mounted with the bore (366) of the proximal adaptor (360) adjacent the proximal end (362).

Further, in order to facilitate the electrical connection of the proximal end (350) of the extension member (348) with the components of the rotary movement assimilating connector (298), as described above, the proximal end (350) is preferably comprised of or associated with a compatible electrical connector or fitting.

Similarly, in order to facilitate the electrical connection of the distal end (352) of the extension member (348) with the components of the longitudinal movement assimilating connector (200), the distal end (352) is preferably comprised of or associated with a compatible electrical connector or fitting.

In addition, the distal end (352) of the extension member (348) is preferably comprised of or associated with a distal adaptor (367). As shown in FIGS. 2*b* and 5, the distal adaptor (367) surrounds or encloses a portion of the distal end (352) of the extension member (348) and provides a splined outer surface (368) for connection with the longitudinal movement assimilating connector (200), as described further below. If desired, the insulative sleeve (356) may extend through the distal adaptor (367) or an alternate insulative component may be provided to insulate the flexible shaft (354) from the adjacent surface of the distal adaptor (367).

Thus, the extension member (348) is electrically connected indirectly with the shaft conductor (40), via the longitudinal movement assimilating connector (200), and in a manner such that the extension member (348) rotates with the shaft conductor (40) but is permitted an amount of longitudinal movement relative thereto as a result of the splined outer surface (367) of the distal adaptor (367). Further, rotation of the extension member (348), comprising the transverse movement assimilating connector (202), moves and rotates the conductive shaft (244) comprising the rotary movement assimilating connector (198). Further, the extension member (348) is electrically connected with the housing conductor (38) via the rotary movement assimilating connector (198).

Referring to FIGS. 2*b*-2*c* and 5, the assimilating connector (32) is further comprised of the longitudinal movement assimilating connector (200) for assimilating a longitudinal movement of the shaft conductor (40) relative to the housing conductor (38). Specifically, the longitudinal movement assimilating connector (200) is provided to absorb, compensate or adjust for longitudinal movement, or movement along or in the direction of the longitudinal axis of the drilling motor (20), of the shaft conductor (40) relative to the housing conductor (38) so that the conducting path (26) through the drilling motor (20) may be maintained. In the preferred embodiment, the longitudinal movement assimilating connector (200) is comprised of a reciprocable contact assembly (369), particularly a reciprocable electrical contact assembly, for electrically connecting the housing conductor (38) with the shaft conductor (40).

FIGS. 2*b*-2*c* and FIG. 5 show alternate configurations of the preferred embodiment of the reciprocable electrical contact assembly (369) which are comprised of substantially the same components functioning in substantially the same manner. Thus, the same reference numbers are used throughout the Figures.

In the preferred embodiment, the reciprocable contact assembly (369) is comprised of a contact assembly housing (370) having a proximal end (372) and a distal end (374) and defining a bore (376) therebetween. The proximal end (372) of the contact assembly housing (370) is connected or engaged with the extension member (348) such that the extension member (348) rotates with the contact assembly housing (370) but is permitted an amount of longitudinal movement relative thereto. More particularly, a housing connector (378) is provided between the contact assembly housing (370) and the distal adaptor (367). The housing connector (378) is fixedly mounted or fastened with the proximal end (372) of the contact assembly housing (37) such that the housing connector (378) rotates therewith. Further, the housing connector (378) includes a splined inner surface (380) compatible with the splined outer surface (368) of the distal adaptor (367). Thus, the housing connector (378) may move longitudinally relative to the distal adaptor (367). Further, the distal end (352) of the extension member (348) extends through the housing connector (378) and within the bore (376) of the contact assembly housing (370) for electrical connection with the reciprocable contact assembly (389).

The distal end (374) of the contact assembly housing (370) is fixedly connected, preferably by a threaded engagement, with the connector housing (192), which is mounted with the proximal end (94) of the rotor (92) such that rotation of the rotor (92) moves and rotates the contact assembly housing (370). Further, the proximal end (180) of the shaft conductive member (176) extends within the bore (376) of the contact assembly housing (370) for electrical connection with the reciprocable contact assembly (389).

Further, the reciprocable contact assembly (389) is comprised of an electrically conductive contact sleeve (382) fixedly mounted and contained within the bore (376) of the contact assembly housing (370). Additionally, the reciprocable contact assembly (389) is comprised of an electrically conductive contact member (384) which is contained within and slidably engaged with the contact sleeve (382) such that the contact sleeve (382) and the contact member (384) are capable of relative reciprocable movement.

More particularly, the contact sleeve (382) has a proximal end (386) and a distal end (388) and defines a bore (390) therein. The bore (390) of the contact sleeve (382) defines a contact chamber (392) for electrical contact or connection between the contact sleeve (382) and the contact member (384). The contact sleeve (382) may be a single unitary component, as shown in FIG. 2*c*, or may be comprised of a plurality of components mounted or affixed together, as shown in FIG. 5, to provide the complete contact sleeve (382). The distal end (352) of the extension member (348) extends within the proximal end (372) of the contact assembly housing (370) and the proximal end (386) of the contact sleeve (382) for electrical connection with the contact member (384). The proximal end (180) of the shaft conductive member (176) extends within the distal end (374) of the contact assembly housing (370) for electrical connection with the distal end (388) of the contact sleeve (382).

As stated, the electrical contact or connection between the contact sleeve (382) and the contact member (384) takes place within the contact chamber (392) as the contact member (384) reciprocates within the contact sleeve (382). In particular, longitudinal movement of the shaft conductor (40) relative to the housing conductor (38) causes the contact member (384) to reciprocate within the contact sleeve (382).

Preferably, the reciprocable contact assembly (369) is further comprised of an electrically conductive contact spring (394) contained within the contact chamber (392) between the distal end (388) of the contact sleeve (382) and the contact member (384) and such that the contact spring (394) is engaged with both the contact sleeve (382) and the contact member (384). Thus, the contact spring (394) enhances the electrical contact of the contact sleeve (382) and the contact member (384) to facilitate the conducting path (26) which extends therethrough. Specifically, the conducting path (26) extends from the extension member (348) and into the contact member (384), from the contact member (384) and across the contact spring (394) to the contact sleeve (382) and from the contact sleeve (382) to the shaft conductive member (176).

If desired, an insulating material may be provided along all or a portion of an outer surface of the contact sleeve (382) in order to insulate the contact sleeve (382) from the adjacent contact assembly (370) and thus, facilitate the conducting path (26) therethrough. Preferably, as shown in FIGS. 2*c* and 5, an insulator sleeve (395) is provided along the length of the contact sleeve (382). Further, an insulator spacer (396) is provided at the proximal end (386) of the contact sleeve (382) between the contact sleeve (382) and the housing connector (378).

In addition, the presence of the contact spring (394) within the contact chamber (392) also provides a means for dampening the relative longitudinal movement between the shaft conductor (40) and the housing conductor (38), and particularly the relative longitudinal movement between the splined outer surface (368) of the distal adaptor (367) of the extension member (348) and the splined inner surface (380) of the housing connector (378).

However, in addition, in the preferred embodiment, the assimilating connector (32) is also comprised of a dampening mechanism (398), as shown in alternate configurations in FIG. 2*b* and FIG. 5, for further dampening the relative longitudinal movement of the shaft conductor (40) and the housing conductor (38). The dampening mechanism (398) may be comprised of any structure, mechanism or device capable of absorbing, reducing or otherwise minimizing or lessening any relative longitudinal movement between the shaft conductor (40) and the housing conductor (38).

However, preferably, the dampening mechanism (398) is comprised of a compensator boot (402) or like mechanism or device for absorbing, reducing or otherwise minimizing or lessening any relative longitudinal movement between the housing connector (378), and the contact assembly housing (370) connected thereto, and the distal adaptor (367), and the extension member (348) connected thereto. More particularly, the compensator boot (402) is an expandable/compressible structure, as shown in FIGS. 2*b* and 5, having a proximal end (404) fixedly connected with the distal adaptor (367) and an opposed distal end (406) fixedly connected with the housing connector (378). Each of the proximal and distal ends (404, 406) of the compensator boot (402) may be fixed in position by any suitable fastener or connecting structure, such as one or more circular clamps.

As well, the dampening mechanism (398) is preferably comprised of a protective housing (408) for substantially surrounding the compensator boot (402). In the preferred embodiment, the protective housing (408) is mounted or fastened with one or both of the distal adaptor (367) and the housing connector (378). The protective housing (408) may be fixed in position by any suitable fastener or connecting structure, such as one or more screws (410). In the event that the protective housing (408) is comprised of a relatively rigid or inflexible material, the protective housing (408) is affixed with one of the distal adaptor (367) and the housing connector (378), preferably the distal adaptor (367) as shown in FIG. 2*b*, in order to permit the longitudinal movement therebetween. Alternately, in the event that the protective housing (408) is comprised of a relatively flexible material, such as rubber, the protective housing (408) may be affixed with both the distal adaptor (367) and the housing connector (378) as shown in FIG. 5. In this instance, one of the fasteners may be comprised of a shear pin (412).

Finally, to summarize, the conducting path (26) extends through the drilling motor (20) as described above between the first axial position (28) and the second axial position (30). Starting from the proximal end (50) of the drilling motor (20) and moving towards the distal end (52), the conducting path (26) extends from the first axial position (28) through the housing conductor (38). More particularly, the conducting path (26) extends through the housing conductive member (160) to the rotary movement assimilating connector (198). In the rotary movement assimilating connector (198), the conducting path (26) extends through the insert housing (224), across the bearing assembly (204) and through the conductive shaft (244). The conducting path (26) then extends into the transverse movement assimilating connector (202). In the transverse movement assimilating connector (202), the conducting path (26) extends through the flexible shaft (354) to the longitudinal movement assimilating connector (200). In the longitudinal movement assimilating connector (200), the conducting path (26) extends from the contact member (384) and across the contact spring (394) to the contact sleeve (382). From the contact sleeve (382), the conducting path (26) extends to the shaft conductor (40), and particularly the shaft conductive member (176). The shaft conductive member (176), and the conducting path (26), extend through the components of the shaft (24), as detailed above, to the second axial position (30).

The embodiments of the invention in which an exclusive property or privilege is claimed are defined as follows:

1. A downhole drilling motor comprising:

(a) a housing;

(b) a shaft extending within the housing, wherein the shaft is movable relative to the housing;

(c) an electrical conducting path extending within the housing between a first axial position and a second axial position, wherein the conducting path comprises:

(i) a housing electrical conductor associated with the housing;

(ii) a shaft electrical conductor associated with the shaft, wherein the shaft electrical conductor is capable of a movement relative to the housing electrical conductor; and (iii) an assimilating connector interposed between the housing electrical conductor and the shaft electrical conductor for electrically connecting the housing electrical conductor with the shaft electrical conductor and for assimilating the movement of the shaft electrical conductor relative to the housing electrical conductor, the assimilating connector comprising:

(A) a rotary movement assimilating connector for assimilating a rotary movement of the shaft electrical conductor relative to the housing electrical conductor, wherein the rotary movement assimilating connector is comprised of a bearing assembly, and wherein the bearing assembly is comprised of a bearing electrical path through the bearing assembly for electrically connecting the housing electrical conductor and the shaft electrical conductor with each other;

(B) a longitudinal movement assimilating connector for assimilating a longitudinal movement of the shaft electrical conductor relative to the housing electrical conductor, wherein the longitudinal movement assimilating connector is comprised of a reciprocable electrical contact assembly for further electrically connecting the housing electrical conductor and the shaft electrical conductor with each other and wherein the reciprocable electrical contact assembly is comprised of an electrically conductive contact sleeve and an electrically conductive contact member slidably engaged with the contact sleeve, wherein the contact sleeve and the contact member are capable of relative reciprocal movement; and (C) a transverse movement assimilating connector for assimilating a transverse movement of the shaft electrical conductor relative to the housing electrical conductor.

2. The drilling motor as claimed in claim 1 wherein the bearing assembly is further comprised of at least one roller bearing and wherein the bearing electrical path is comprised of the roller bearing.

3. The drilling motor as claimed in claim 1 wherein the bearing assembly is further comprised of at least one tapered roller bearing and wherein the bearing electrical path is comprised of the tapered roller bearing.

4. The drilling motor as claimed in claim 1 wherein the bearing assembly is further comprised of at least one hollow tapered roller bearing and wherein the bearing electrical path is comprised of the hollow tapered roller bearing.

5. The drilling motor as claimed in claim 1 wherein the bearing assembly is further comprised of a preloading mechanism for preloading the bearing assembly.

6. The drilling motor as claimed in claim 1 wherein the bearing assembly defines a bearing chamber and wherein an electrically conductive fluid is contained in the bearing chamber.

7. The drilling motor as claimed in claim 1 wherein the assimilating connector is further comprised of an electrically conductive extension member, wherein the electrically conductive extension member is electrically connected with the shaft electrical conductor, and wherein the bearing assembly is interposed between the housing electrical conductor and the electrically conductive extension member so that the housing electrical conductor and the shaft electrical conductor are electrically connected with each other.

8. The drilling motor as claimed in claim 1 wherein one of the contact sleeve and the contact member is electrically connected with the housing electrical conductor and wherein the other of the contact sleeve and the contact member is electrically connected with the shaft electrical conductor.

9. The drilling motor as claimed in claim 8 wherein the contact sleeve and the contact member define a contact chamber, wherein the reciprocable contact assembly is further comprised of an electrically conductive contact spring, and wherein the contact spring is contained in the contact chamber such that the contact spring is engaged with both the contact sleeve and the contact member.

10. The drilling motor as claimed in claim 9 wherein the assimilating connector is further comprised of an electrically conductive extension member, wherein the electrically conductive extension member is electrically connected with the housing electrical conductor, and wherein the reciprocable contact assembly is interposed between the shaft electrical conductor and the electrically conductive extension member so that the housing electrical conductor and the shaft electrical conductor are electrically connected with each other.

11. The drilling motor as claimed in claim 9 wherein the assimilating connector is further comprised of a dampening mechanism for dampening the relative longitudinal movement of the shaft electrical conductor and the housing electrical conductor.

12. The drilling motor as claimed in claim 1 wherein the transverse movement assimilating connector is comprised of an electrically conductive extension member for electrically connecting the housing electrical conductor and the shaft electrical conductor with each other.

13. The drilling motor as claimed in claim 12 wherein the extension member is comprised of a flexible shaft.

14. The drilling motor as claimed in claim 13 wherein the rotary movement assimilating connector is interposed between the housing electrical conductor and the extension member and wherein the longitudinal movement assimilating connector is interposed between the shaft electrical conductor and the extension member.

15. An assimilating connector for interposing between a first electrical conductor and a second electrical conductor in order to electrically connect the first electrical conductor with the second electrical conductor and in order to assimilate a movement of the first electrical conductor relative to the second electrical conductor, the assimilating connector comprising:

(a) a rotary movement assimilating connector for assimilating a rotary movement of the first electrical conductor relative to the second electrical conductor, wherein the rotary movement assimilating connector is comprised of a bearing assembly, and wherein the bearing assembly is comprised of a bearing electrical path through the bearing assembly for electrically connecting the first electrical conductor and the second electrical conductor with each other;

(b) a longitudinal movement assimilating connector for assimilating a longitudinal movement of the first electrical conductor relative to the second electrical conductor, wherein the longitudinal movement assimilating connector is comprised of a reciprocable electrical contact assembly for further electrically connecting the first electrical conductor and the second electrical conductor with each other and wherein the reciprocable electrical contact assembly is comprised of an electrically conductive contact sleeve and an electrically conductive contact member slidably engaged with the contact sleeve, wherein the contact sleeve and the contact member are capable of relative reciprocal movement; and (c) a transverse movement assimilating connector for assimilating a transverse movement of the first conductor relative to the second conductor.

16. The assimilating connector as claimed in claim 15 wherein the bearing assembly is further comprised of at least one roller bearing and wherein the bearing electrical path is comprised of the roller bearing.

17. The assimilating connector as claimed in claim 15 wherein the bearing assembly is further comprised of at least one tapered roller bearing and wherein the bearing electrical path is comprised of the tapered roller bearing.

18. The assimilating connector as claimed in claim 15 wherein the bearing assembly is further comprised of at least one hollow tapered roller bearing and wherein the bearing electrical path is comprised of the hollow tapered roller bearing.

19. The assimilating connector as claimed in claim 15 wherein the bearing assembly is further comprised of a preloading mechanism for preloading the bearing assembly.

20. The assimilating connector as claimed in claim 15 wherein the bearing assembly defines a bearing chamber and wherein an electrically conductive fluid is contained in the bearing chamber.

21. The assimilating connector as claimed in claim 15 wherein the assimilating connector is further comprised of an electrically conductive extension member, wherein the electrically conductive extension member is electrically connected with the second electrical conductor, and wherein the bearing assembly is interposed between the first electrical conductor and the electrically conductive extension member so that the first electrical conductor and the second electrical conductor are electrically connected with each other.

22. The assimilating connector as claimed in claim 15 wherein one of the contact sleeve and the contact member is electrically connected with the first electrical conductor and wherein the other of the contact sleeve and the contact member is electrically connected with the second electrical conductor.

23. The assimilating connector as claimed in claim 22 wherein the contact sleeve and the contact member define a contact chamber, wherein the reciprocable contact assembly is further comprised of an electrically conductive contact spring, and wherein the contact spring is contained in the contact chamber such that the contact spring is engaged with both the contact sleeve and the contact member.

24. The assimilating connector as claimed in claim 23 wherein the assimilating connector is further comprised of an electrically conductive extension member, wherein the electrically conductive extension member is electrically connected with the first electrical conductor, and wherein the reciprocable contact assembly is interposed between the second electrical conductor and the electrically conductive extension member so that the first electrical conductor and the second electrical conductor are electrically connected with each other.

25. The assimilating connector as claimed in claim 23 wherein the assimilating connector is further comprised of a dampening mechanism for dampening the relative longitudinal movement of the second electrical conductor and the first electrical conductor.

26. The assimilating connector as claimed in claim 15 wherein the transverse movement assimilating connector is comprised of an electrically conductive extension member for electrically connecting the first electrical conductor and the second electrical conductor with each other.

27. The assimilating connector as claimed in claim 26 wherein the extension member is comprised of a flexible shaft.

28. The assimilating connector as claimed in claim 27 wherein the rotary movement assimilating connector is interposed between the first electrical conductor and the extension member and wherein the longitudinal movement assimilating connector is interposed between the second electrical conductor and the extension member.

29. The assimilating connector as claimed in claim 26 wherein the rotary movement assimilating connector is interposed between the first electrical conductor and the extension member and wherein the longitudinal movement assimilating connector is interposed between the second electrical conductor and the extension member.

* * * * *